US009776770B2

(12) United States Patent
Petkovsek et al.

(10) Patent No.: US 9,776,770 B2
(45) Date of Patent: Oct. 3, 2017

(54) CHILD RESISTANT ZIPPER CLOSURE FOR RECLOSEABLE POUCH WITH DOUBLE SLIDER AND METHODS

(71) Applicant: Reynolds Presto Products Inc., Richmond, VA (US)

(72) Inventors: Gregory L. Petkovsek, Waupaca, WI (US); Roger E. Dowler, Rochester, MN (US); Gregg Thompson, Canandaigua, NY (US); Samuel D. Aversa, Canandaigua, NY (US)

(73) Assignee: Reynolds Presto Products Inc., Lake Forest, IL (US)

( * ) Notice: Subject to any disclaimer, the term of this patent is extended or adjusted under 35 U.S.C. 154(b) by 560 days.

(21) Appl. No.: 14/202,704

(22) Filed: Mar. 10, 2014

(65) Prior Publication Data

US 2014/0311102 A1 Oct. 23, 2014

Related U.S. Application Data

(60) Provisional application No. 61/792,384, filed on Mar. 15, 2013.

(51) Int. Cl.

| | |
|---|---|
| ***B65D 33/25*** | (2006.01) |
| ***A44B 19/24*** | (2006.01) |
| ***A44B 19/26*** | (2006.01) |

(52) U.S. Cl.

CPC ..... *B65D 33/2591* (2013.01); *A44B 19/24* (2013.01); *A44B 19/265* (2013.01); *B65D 2215/00* (2013.01); *Y10T 24/2502* (2015.01)

(58) Field of Classification Search

CPC ..... A44B 19/267; A44B 19/382; B65D 33/2591; Y10T 24/2502

See application file for complete search history.

(56) References Cited

U.S. PATENT DOCUMENTS 4,395,891 A * 8/1983 Remington ..... A44B 19/301 70/68

4,514,884 A 5/1985 Kaneko (Continued)

FOREIGN PATENT DOCUMENTS

CN 102490974 6/2012

CN 102490974 A 6/2012

(Continued)

OTHER PUBLICATIONS

International Search Report and Written Opinion for PCT/US2014/023669 mailed Jun. 20, 2014.

(Continued)

*Primary Examiner* — David Upchurch

(74) *Attorney, Agent, or Firm* — Merchant & Gould P.C.

(57) ABSTRACT

A child resistant zipper closure for a plastic bag includes a double slider, including a first slider and second slider. The first and second sliders are oriented on the zipper closure such that when at least one of the first slider and second slider is moving in a direction toward the other of the first slider and second slider, the zipper is interlocking; and when at least one of the first slider and second slider is moving in a direction away from the other of the first slider and second slider, the zipper is unlocking. The first and second sliders can be realeasably connected together.

7 Claims, 18 Drawing Sheets

(56) References Cited

U.S. PATENT DOCUMENTS

| | | | | |
|---|---|---|---|---|
| 4,578,966 | A * | 4/1986 | Kasai | A44B 19/301 24/418 |
| 4,976,120 | A * | 12/1990 | Terada | A44B 19/301 70/312 |
| 4,991,873 | A * | 2/1991 | Matsui | B60R 22/06 16/95 R |
| 5,007,143 | A | 4/1991 | Herrington | |
| 5,063,760 | A * | 11/1991 | Horita | A44B 19/301 70/23 |
| 5,283,932 | A | 2/1994 | Richardson et al. | |
| 5,711,609 | A | 1/1998 | Simonsen | |
| 6,361,213 | B2 | 3/2002 | Randall | |
| 6,376,035 | B1 | 4/2002 | Dobreski et al. | |
| 6,431,754 | B1 * | 8/2002 | Savicki, Sr. | A44B 19/267 156/73.1 |
| 6,510,593 | B1 | 1/2003 | Kim | |
| 7,073,233 | B2 | 7/2006 | Leva et al. | |
| D526,931 | S * | 8/2006 | Koenig | D11/221 |
| 7,251,864 | B2 | 8/2007 | Chang | |
| 7,506,417 | B2 * | 3/2009 | Yoneoka | A44B 19/301 24/386 |
| 7,670,052 | B2 | 3/2010 | Chaturvedi | |
| 8,087,826 | B1 | 1/2012 | Blythe et al. | |
| 2003/0014848 | A1 | 1/2003 | LaRue et al. | |
| 2005/0204516 | A1 | 9/2005 | Leva et al. | |
| 2010/0011545 | A1 | 1/2010 | Anzini | |
| 2011/0126384 | A1 * | 6/2011 | Ozaki | B65D 33/2591 24/430 |

FOREIGN PATENT DOCUMENTS

| | | | |
|---|---|---|---|
| EP | 365830 | A3 | 5/1990 |
| EP | 377798 | B1 | 1/1994 |
| EP | 1752057 | A2 | 2/2007 |
| GB | 1477290 | A | 6/1977 |
| WO | 9508280 | A1 | 3/1995 |
| WO | WO 02/03824 | | 1/2002 |
| WO | WO 2007/038465 | | 4/2007 |
| WO | WO 2013-078722 | A1 | 6/2013 |

OTHER PUBLICATIONS

New Zealand Examination Report in Application 711247; mailed Jul. 6, 2017, 6 pgs.

* cited by examiner

CHILD RESISTANT ZIPPER CLOSURE FOR RECLOSEABLE POUCH WITH DOUBLE SLIDER AND METHODS

This application claims priority to U.S. provisional patent application 61/792,384, filed Mar. 15, 2013, incorporated herein by reference in its entirety.

TECHNICAL FIELD

This disclosure relates to reclosable zipper pouch. More particularly, this disclosure relates to a reclosable zipper pouch that is child resistant.

BACKGROUND

A reclosable pouch having a slider operated zipper closure is easy to open for children and adults. If the pouch is intended to have contents that are potentially harmful, there is a need to provide a closure and method to increase the difficulty for children to open the pouch and yet still be easy to open for adults and senior citizens.

SUMMARY

In one aspect, this disclosure provides a child resistant slider zipper closure system having two moveable sliders.

The sliders can be physically linked together and slide as a single unit.

The two sliders can be physically released from one another and slide individually.

When the sliders are linked, the zipper closure remains closed when the linked sliders are slid in any direction.

When the sliders are released from one another, the zipper closure can be opened by moving one or both sliders in a direction opposite one another.

The two sliders may include a projection-receiver arrangement to allow selective, releasable connection therebetween.

In some aspects, the projection-receiver arrangement includes a tab with a protuberance extending from one of the two sliders and an aperture sized to receive the protuberance in the other of the two sliders.

In some aspects, the projection-receiver arrangement includes a lobed projection extending from one of the two sliders and an aperture sized to receive the lobed projection and the other of the two sliders.

In some aspects, each of the two sliders has both a projection and a receiver.

In some aspects, the two sliders each have a top member and a pair of sidewalls extending from the top member. The projection-receiver arrangement includes at least one of a receiver defined by one of the sidewalls, or a deflectable tang.

In another aspect, this disclosure provides a flexible package with a child resistant slider zipper closure system having two moveable sliders.

In the package, the two sliders can be physically linked together and slide as a single unit.

In the package, the two sliders can be physically released from one another and slide individually.

In the package, when the sliders are linked, the zipper closure remains closed and the linked sliders can be slid in any direction.

In the package, when the sliders are released from one another, the zipper closure can be opened by moving one or both sliders in a direction opposite one another.

In another aspect, a double slider for a plastic zipper closure having a male track and a female track including interlocking male and female profiles is provided. The double slider includes a first slider having a body with an opening end and a closing end. The body includes a top member and first and second sidewalls extending therefrom. The first slider has a separator fingered depending from the internal surface of the top member and between the first and second sidewalls. The separator finger is wider toward the opening end of the first slider than at the closing end of the first slider to permit separation of the male and female profiles by the wider end of the finger. The first and second sidewalls have internal surfaces spaced sufficiently close together toward the closing end to engage the male and female profiles into interlocking relationship as the first slider is moved along the tracks. A second slider, releasably connected to the first slider has a body with a first end and a second end. The second slider body has a top member and first and second sidewalls extending therefrom. The first and second sidewalls of the second slider have internal surfaces spaced sufficiently close together to engage the male and female profiles into interlocking relationship as the second slider is moved along the tracks. The first slider and second slider are selectively releasably connected together between an engaged position and a disengaged position. In the engaged position, the first and second sliders move together along the top edges of the track, and the opening end of the first slider body is against the first end of the second slider body. In the disengaged position, the first and second sliders move independent of each other along the top edges of the track.

The first slider and second slider can have a projection-receiver arrangement to allow for the selective releasable connection therebetween.

In some aspects, the projection-receiver arrangement can include a tab with a protuberance extending from one of the first and second sliders and an aperture sized to receive the protuberance in the other of the first and second sliders.

In some aspects, the projection-receiver arrangement can include a lobed projection extending from one of the first and second sliders and an aperture sized to receive the lobed projection in the other of the first and second sliders.

In some aspects, each of the first slider and second slider has both a projection and a receiver.

In some aspects, the projection-receiver arrangement includes at least one of a receiver defined by one of the sidewalls, or a deflectable tang.

In some aspects, the second slider has a separator finger depending from an internal surface of the top member and between the first and second sidewalls. The second slider body is adapted to move along top edges of the tracks with the first and second sidewalls straddling the tracks, and the finger positioned between the tracks. The second slider separator finger is wider toward the first end of the second slider than at the second end of the second slider.

In some aspects, the second slider is separator-finger free and operates to engage the male and female profiles into interlocking relationship as the second slider is moved along the tracks.

In some aspects, the projection-receiver arrangement includes at least one deflectable tang having a locking shoulder on at least one of the first slider and second slider, and a cavity with a catch defined by the other of the first slider and second slider sized to receive the deflectable tang and engage the locking shoulder and catch.

In some aspects, the at least one deflectable tang includes first and second deflectable tangs on the first slider, the first and second deflectable tangs being deflectable toward and away from each other and from a longitudinal axis through the first slider. The second slider defines the cavity and at least first and second catches to engage the first and second tangs.

In some aspects, the at least one deflectable tang projects from the top member of the first slider, and the catch is defined by the top member of the second slider.

In some aspects, the projection-receiver arrangement includes at least one tab projecting from at least one of the sidewalls of the first and second sliders, and the other of the first and second sliders has at least one receiver defined by one of the sidewalls sized to receive the tab.

In another aspect, a zippered plastic bag is provided. The bag includes first and second opposing panels each having a top forming the mouth, a bottom, and first and second sides. A zipper closure is in proximity to the top of the first panel and second panel for interlocking to close the mouth and for unlocking to open the mouth. A first slider is located on the zipper closure and cooperates with the zipper closure in opening and closing the mouth by moving along the male and female tracks. A second slider is located on the zipper closure and cooperates with the zipper closure by moving along the zipper closure and at least closing the mouth. The first slider and the second slider are oriented on the zipper closure such that when at least one of the first slider and second slider is moving in a direction toward the other of the first slider and second slider, the zipper closure is interlocking. When at least one of the first slider and second slider is moving in a direction away from the other of the first slider and second slider, the zipper closure is unlocking.

In some aspects, for the zippered plastic bag, the first slider and second slider are releasably connected together.

In some aspects, the first slider and second slider have a projection-receiver arrangement to allow the selective releasable connection therebetween.

In some examples, at least one member of the projection-receiver arrangement is on the first slider, and at least one member of the projection-receiver arrangement is on the second slider.

In some examples, the projection-receiver arrangement includes a tab with a protuberance extending from one of the first and second sliders and an aperture sized to receive the protuberance in the other of the first and second sliders.

In some examples, the projection-receiver arrangement includes a lobed projection extending from one of the first and second sliders and an aperture sized to receive the lobed projection in the other of the first and second sliders.

In some examples, each of the first slider and second slider has both a projection and a receiver.

In some aspects, each of the first slider and second slider has an opening end and a closing end. The opening end of the first slider is closer to the opening end of the second slider than the closing end of the second slider.

In some aspects, the second slider is separator-finger free and operates only to close the mouth.

In some examples, the first slider and second slider each has a top member and a pair of sidewalls extending from the top member. The projection-receiver arrangement includes at least one of a receiver defined by one of the sidewalls, or a deflectable tang.

In some examples, the first slider and second slider are configured and arranged so that when both the first slider and second slider are moving in a direction away from the other of the first slider and second slider, the zipper closure is unlocking by both the first slider and second slider.

In some aspects, the projection-receiver arrangement includes at least one deflectable tang having a locking shoulder on at least one of the first slider and second slider, and a cavity with a catch defined by the other of the first slider and second slider sized to receive the deflectable tang and engage the locking shoulder and catch.

In some aspects, the projection-receiver arrangement includes at least one tab projecting from at least one of the sidewalls of the first and second sliders and the other of the first and second sliders has at least one receiver defined by one of the sidewalls sized to receive the tab.

In another aspect, a method of operating a zippered plastic bag having an openable and recloseable mouth is provided. The method includes providing a zippered plastic bag having first and second panels each having a top forming the mouth, a bottom, and first and second opposing sides joined together. A zipper closure is in proximity to the top of the first panel and second panel for interlocking to close the mouth and for unlocking to open the mouth. A first slider is located on the zipper closure and a second slider is located on the zipper closure. The method includes a step of opening the mouth by unlocking the zipper closure by moving at least one of the first slider and second slider in a direction away from the other of the first slider and second slider.

The method can include closing the mouth by interlocking the zipper closure by moving at least one of the first slider and second slider in a direction toward the other of the first slider and second slider.

The step of opening the mouth by unlocking the zipper closure can include releasing a connection between the first slider and second slider.

The step of releasing a connection between the first slider and second slider may include releasing a projection on the first slider from a receiver in the second slider.

The step of releasing a projection on the first slider from a receiver in the second slider can include releasing a projection from a receiver defined by a sidewall of the second slider.

The step of releasing a projection on the first slider from a receiver in the second slider can include releasing a deflectable tang on the first slider from a cavity defined by the second slider.

A variety of examples of desirable product features or methods are set forth in part in the description that follows, and in part will be apparent from the description, or may be learned by practicing various aspects of this disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

A. FIGS. 1-8

Figure 1:
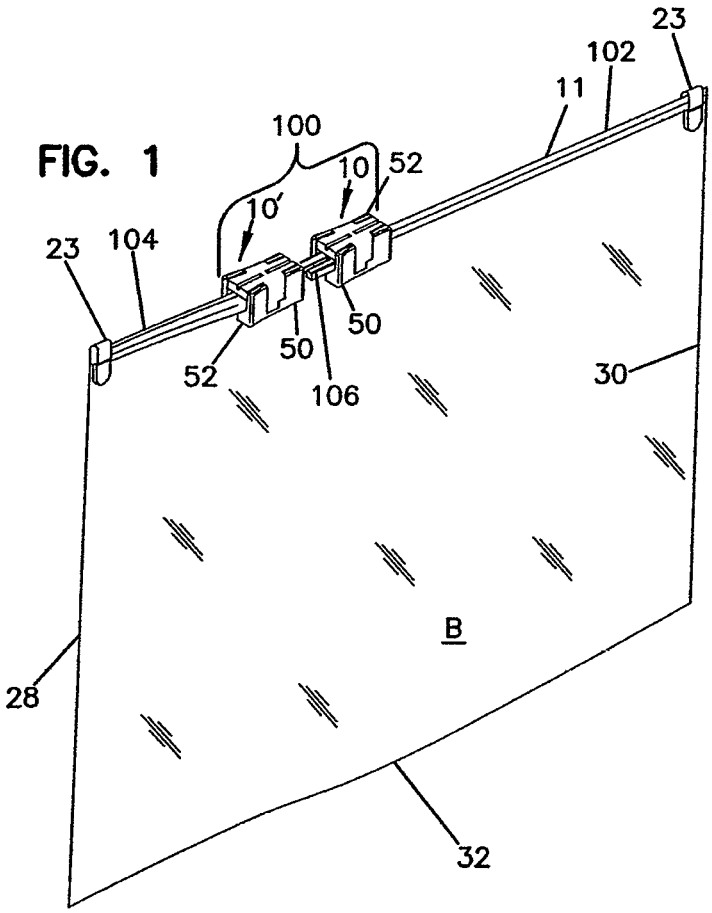
FIG. 1 is a perspective view of a thermoplastic bag having a fastener and double slider in a disengaged position, constructed in accordance with principles of this disclosure.

Referring to FIG. 1, there is illustrated a plastic double slider 100 and a profiled plastic fastener or zipper closure 11. The double slider 100 includes a first slider 10 and a second slider 10', which can be selectively engaged (or connected) and disengaged (or disconnected).

Figure 2:
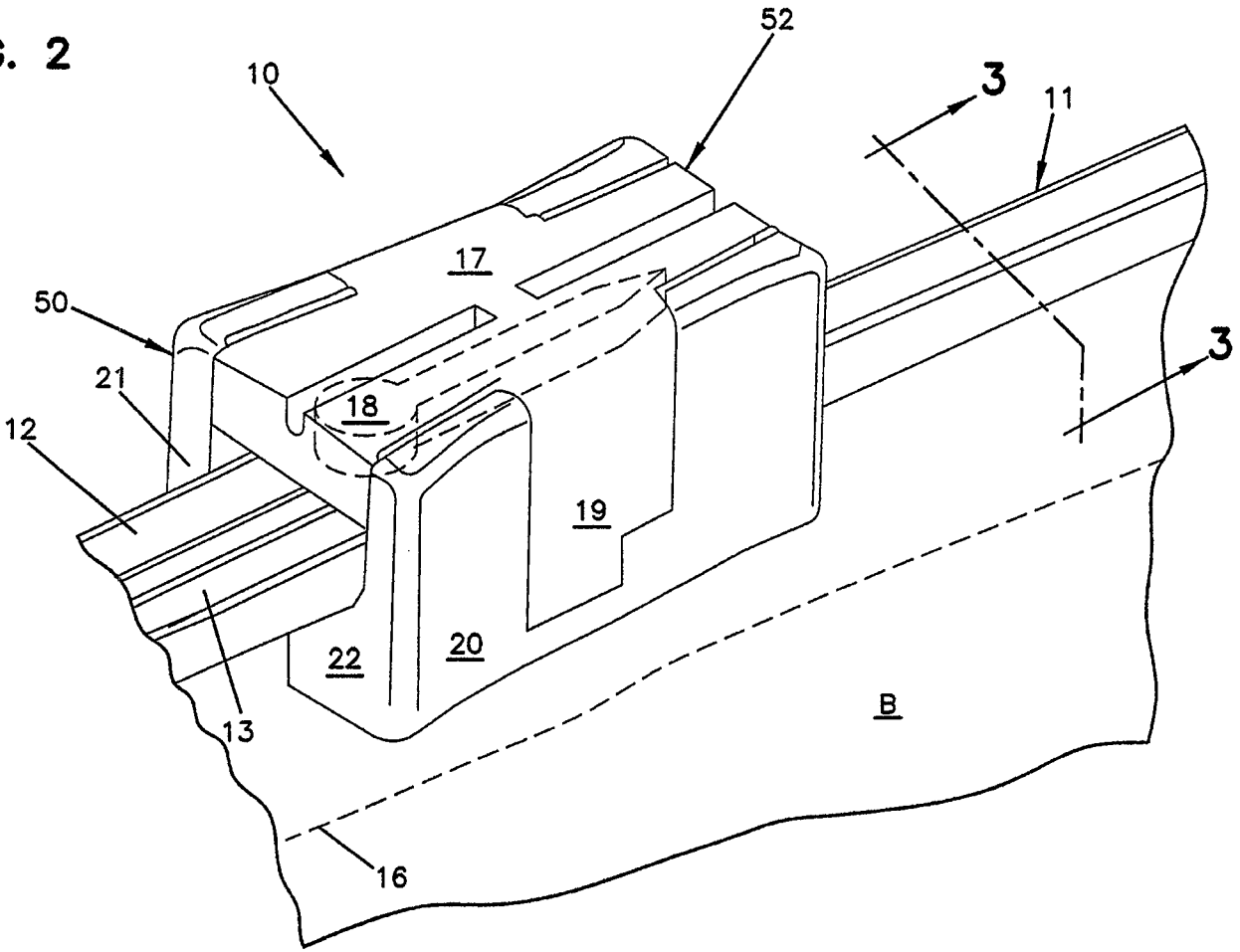
FIG. 2 is an enlarged perspective view of the fastener and one of the sliders of FIG. 1 in assembled position on a thermoplastic bag.

The first slider 10 has been illustrated in FIG. 2 assembled on the zipper closure 11 at the top edge or mouth 40 of a thermoplastic bag or package B. It should be understood that the first slider 10 and second slider 10' have the same internal structure, and they operate to open and close the bag B in the same manner, but in opposite directions. Thus, description of first slider 10 is also a description of second slider 10'.

Figure 3:
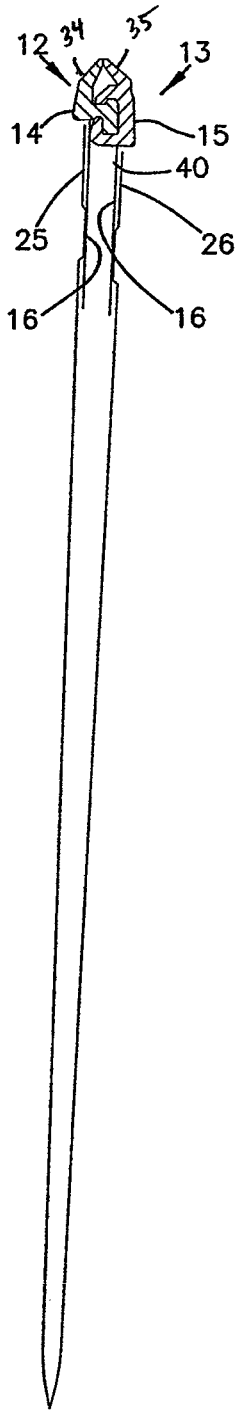
FIG. 3 is a cross-sectional view taken generally along lines 3-3 in FIG. 2.

In the example embodiment, the bag B (as shown in FIGS. 1 and 3) is formed from a single flexible plastic sheet folded upon itself and comprises first and second opposing body panels 25 and 26. Body panels 25 and 26 are fixedly connected to each other along a pair of sides 28 and 30 and a bottom 32 which extends between the pair of sides 28 and 30. Bag B preferably has the zipper closure 11 extending along a mouth formed opposite the bottom 32 of bag B, in which the zipper closure 11 has a male track 12 and a female track 13.

As shown in FIGS. 2 and 3, tracks 12 and 13 have interlocking male and female profiles 14 and 15 extending the length thereof in the form of rib and groove elements on the respective tracks. The tracks 12 and 13 may be extruded separately with a fin and attached to the respective sides of the bag mouth 40, or may be extruded integrally with the sides of the bag mouth 40. If the tracks 12 and 13 are extruded separately, they are most effectively attached by means of a respective first and second fin 16, incorporated within the tracks, that is heat sealed to the bag mouth 40. The male and female profiles 14 and 15 have complementary cross-sectional shapes and are closed by pressing a bottom of the elements together first and then rolling the elements to a closed position toward the top thereof. The cross-sectional shapes of the interlocking male and female profiles 14 and 15 are described in U.S. Pat. No. 5,007,143, which is incorporated herein by reference.

In FIG. 2, only the first slider 10 is illustrated. The first slider 10 straddles the zipper closure 11 at the top of the bag B and is adapted for opening or closing the interlocking tracks 12 and 13 of the zipper closure 11. The first slider 10 and second slider 10' may be molded from any suitable plastic such as, for example, nylon, polypropylene, polyethylene, polystyrene, Delrin, or ABS. The first slider 10 and second slider 10', in this example, is described in U.S. Pat. No. 6,376,035, which is incorporated herein by reference.

In an example embodiment, shown in FIG. 2, the first slider 10 comprises an inverted U-shaped member including a transverse support member or body 17 from which the separator finger 18 extends downward. The body 17 is itself U-shaped and includes two integral legs 19 extending downward. The finger 18 is positioned between the legs 19. The body further includes opposite side walls 20, 21, which each has an inwardly extending shoulder structure 22. The body 17 is adapted to move along the top edges of the tracks 12 and 13 with the legs 19 straddling these elements and the finger 18 positioned between the tracks 12 and 13. Shoulder structure 22 engages a bottom of the zipper closure 11 to prevent the first slider 10 from being lifted off the edges of the tracks 12 and 13, while the first slider 10 straddles the zipper closure 11.

The first slider 10 has an opening end 50 and a closing end 52. It will also be noted that the main slider body 17 and the separator finger 18 are wider toward the opening end 50 than at the closing end 52. Similarly, the side walls 20 and 21 and the legs 19 have internal surfaces that are spaced wider apart at or adjacent or toward the opening end 50 of the first slider 10 to permit separation of the male and female profiles 14 and 15 by the finger 18 engaging the tracks 12 and 13. The sidewalls 20 and 21 and legs 19 have internal surfaces that are spaced sufficiently close together at or adjacent or toward the closing end 52 of the first slider 10 to press, or engage, the male and female profiles 14 and 15 into an interlocking relationship as the first slider 10 is moved in a fastener closing direction. Many embodiments are possible, and it should be understood that external surfaces of the first slider 10 can take almost any configuration without affecting the operation of the slider 10.

In this example embodiment, the opposite ends of the zipper closure 11 are provided with end termination clips 23 (FIG. 1). Each end clip 23 comprises a strap member which wraps over the top of the zipper closure 11.

As mentioned previously, the first slider 10 and second slider 10' have the same internal structure, and they operate to open and close the bag in the same manner, but in opposite directions. Thus, from a review of FIG. 1, it should be appreciated that the first slider 10 and second slider 10' are oriented on the zipper closure 11 such that when at least one of the first slider 10 and second slider 10' is moving in a direction toward the other of the first slider 10 and second slider 10', the zipper closure 11 is interlocking, to close the mouth 40. When at least one of the first slider 10 and second slider 10' is moving in a direction away from the other of the first slider 10 and second slider 10', the zipper closure 11 is unlocking, and the mouth 40 is opening.

In the example shown in FIG. 1, when the first slider 10 is moved in a direction toward side 30, and away from the second slider 10', the zipper closure 11 between the second slider 10' and first slider 10 is unlocking, and the mouth 40 is opening in that section. When the first slider 10 is moving in a direction away from side 30 and in a direction toward second slider 10' and toward side 28, the zipper closure 11 is interlocking to close the mouth for the zipper closure section that is between the first slider 10 and the side 30.

Similarly, when the second slider 10' is moving in a direction toward the side 28 and away from the first slider 10, the zipper closure 11 between the first slider 10 and second slider 10' is unlocking to open the mouth 40 in that section. When the second slider 10' is moving toward side 30 and first slider 10, the zipper closure 11 between the side 28 and second slider 10' is closing.

As can be seen in FIG. 1, the first slider 10 and second slider 10' are oriented on the zipper closure 11 relative to each other such that the opening end 50 of each first slider 10 and second slider 10' are adjacent to each other, when the first slider 10 and second slider 10' are in engagement next to each other. It can be seen that the opening end 50 of the first slider 10 is closer to the opening end 50 of the second slider 10' than it is to the closing end 52 of the second slider 10'. Similarly, the opening end 50 of the second slider 10' is closer to the opening end 50 of the first slider 10 than it is to the closing end 52 of the first slider 10.

When the first slider 10 and second slider 10' are immediately adjacent to each other and the closing ends 50 are against each other, it should be appreciated that when the first slider 10 and second slider 10' are moved together along the zipper closure 11, the zipper closure 11 will remain interlocked and the mouth 40 closed in the sections 102, 104 of the zipper closure 11 that are between the respective closing end 52 and the sides 28, 30. In the example shown in FIG. 1, the section 102 remains closed between closing end 52 of the first slider 10 and the side 30, while the section 104 remains closed between the closing end 52 of the second slider 10' and the side 28. In the example shown in FIG. 1, there is a section 106 of the zipper closure 11 that is unlocked to provide an opening at the mouth 40. The section 106 is a section between the opening ends 50 of the first slider 10 and second slider 10'.

In accordance with principles of this disclosure, the first slider 10 and second slider 10' can be selectively releasably connected together between an engaged position and a disengaged position. In the engaged position, the first and second sliders 10, 10' move together along the top edges of the tracks 12, 13. In the disengaged position, the first and second sliders 10, 10' move independent of each other along the top edges of the tracks 12, 13. When the sliders 10, 10' are engaged and move together, the zipper closure 11 will remain interlocked and the mouth 40 closed in the sections 102, 104 of the zipper closure 11 that are between the closing end 52 and the sides 28, 30. This can function as a child-resistant feature to opening the mouth 40 in that a child will not easily understand that the first and second sliders 10, 10' need to be separated or disengaged and moved apart from each other to unlock the zipper closure 11 and open the mouth 40.

FIGS. 4-8 show example embodiments of engagement structure to allow the releasable connection between the first slider 10 and second slider 10'. The examples shown in FIGS. 4-8 are each double sliders 100, including first and second sliders that can function as described for first slider 10 and second slider 10'. Of course, alternatives are possible.

In general, the releasable connection between the first slider 10 and second slider 10' can be a projection-receiver arrangement 110. The projection-receiver arrangement 110 allows for selective releasable connection between the first slider 10 and second slider 10'. The projection-receiver arrangement 110 will include at least one of a projection 112 and one of a receiver 114. The projection 112 can be on either the first slider 10 or second slider 10'. Similarly, the receiver 114 can be on either the first slider 10 or second slider 10'. The projection 112 and receiver 114 are complementary to each other, such that the receiver 114 is sized to receive the projection 112 to operably connect the first slider 10 and second slider 10', and also to allow selective disconnection by removing the projection 112 from the receiver 114.

Figure 7:
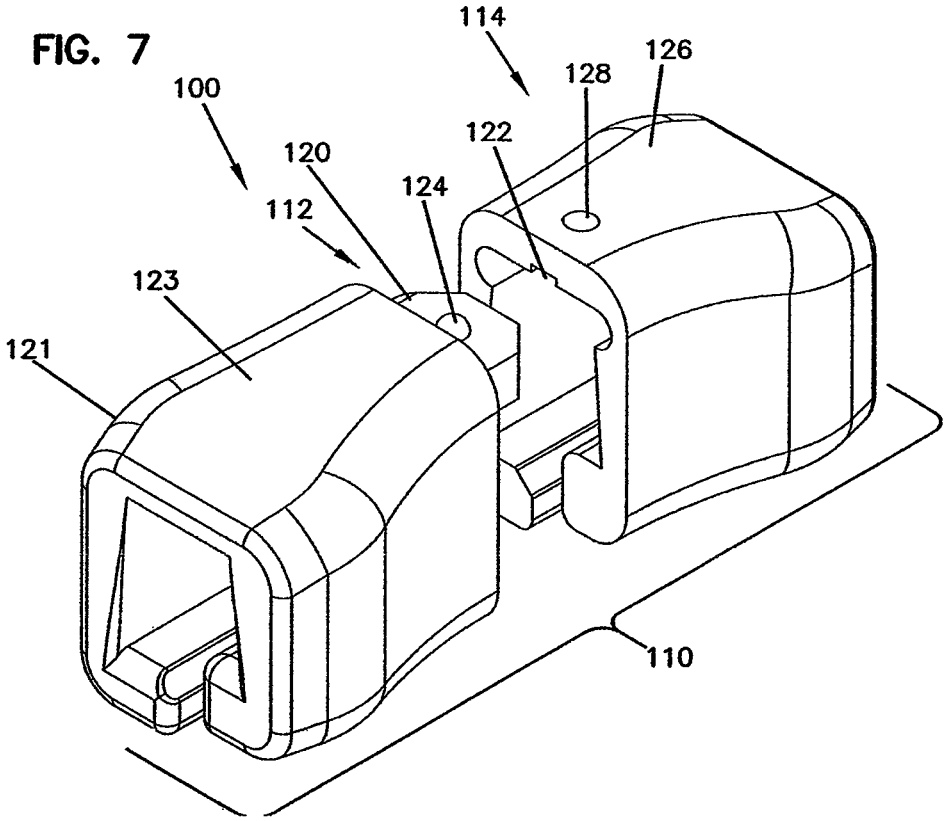
FIG. 7 is a schematic perspective view of another example embodiment of a double slider, useable with the fastener of FIGS. 1-3, the double slider being in a disengaged position.

In the example embodiment of FIG. 7, the projection-receiver arrangement 110 includes tab 120 on a first slider 121. The tab 120, in the embodiment show, generally extends from a top member 123 of the first slider 121, and is recessed from a top plane of the top member 123. The tab 120 has a protuberance 124 projecting therefrom. The second slider 122 is sized to receive the tab 120 just below the top member 126 of the second slider 122. There is an aperture 128 in the second slider 122 oriented to receive the protuberance 124. In the embodiment shown, the aperture 128 is in the top member 126. In this manner, the tab 120 is received by the second slider 122 under the top member 126 of the second slider 122, and the protuberance 124 can be releasably fitted within the aperture 128.

Figure 8:
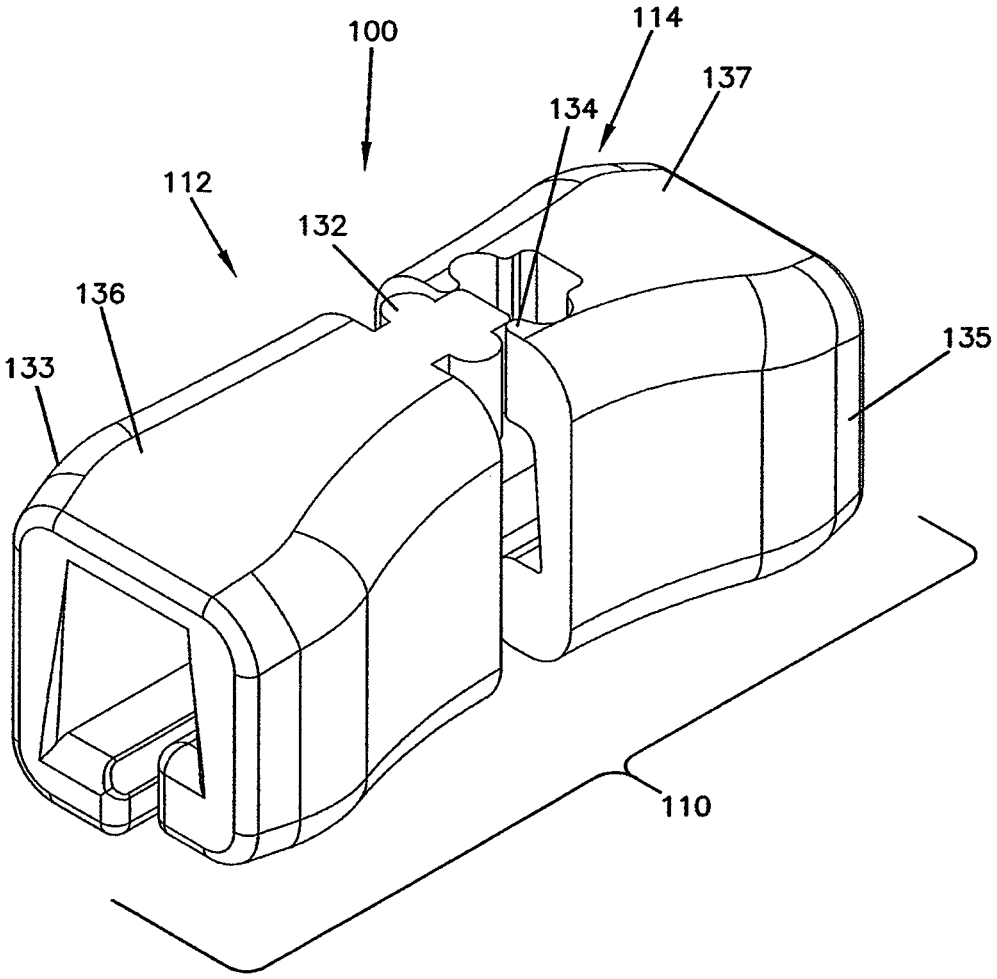
FIG. 8 is a schematic perspective view of another example embodiment of a double slider, useable with the fastener of FIGS. 1-3, the double slider being in a disengaged position.
Figure 9:
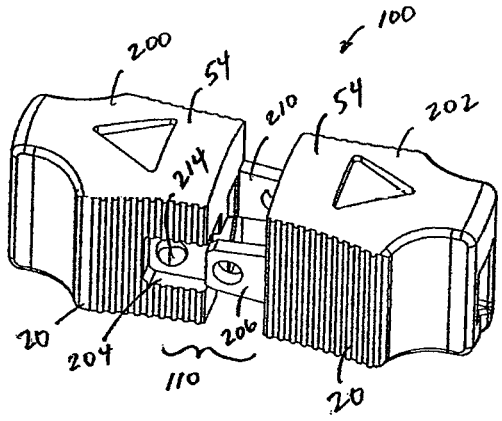
FIG. 9 is a perspective view of another embodiment of a double slider, usable with the fastener of FIGS. 1-3, the double slider being in a disengaged position.
Figure 10:
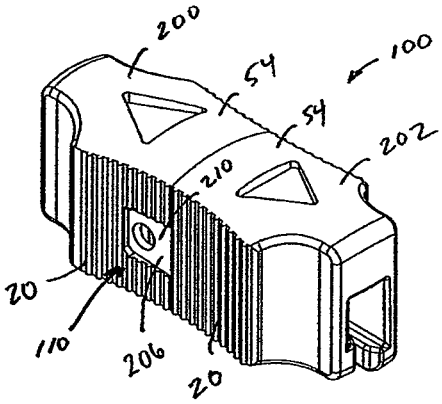
FIG. 10 is a perspective view of the double slider of FIG. 9 in an engaged position.

In the example shown in FIG. 8, the projection-receiver arrangement 110 includes a lobed projection 132 extending from first slider 133, and an aperture 134 in the second slider 135 sized to receive the lobed projection 132. In the example embodiment shown, the lobed projection 132 extends from the top member 136 of the first slider 133. The lobed projection 132 is shown with three lobes, but of course, many other shapes for the lobed projection 132 are possible. The aperture 134, in this embodiment, is in the top member 137 of the second slider 135. The aperture 134 is shaped as the complement of the lobed projection 132. Of course, alternatives are possible.

Figure 4:
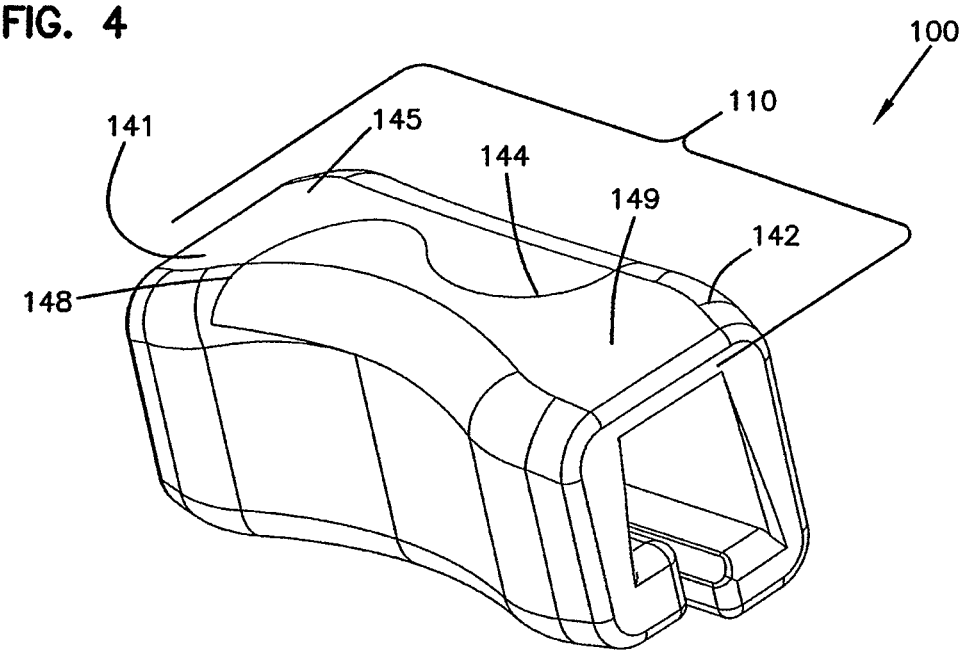
FIG. 4 is a schematic perspective view of an example embodiment of a double slider, useable with the fastener of FIGS. 1-3, the double slider being in an engaged position.
Figure 5:
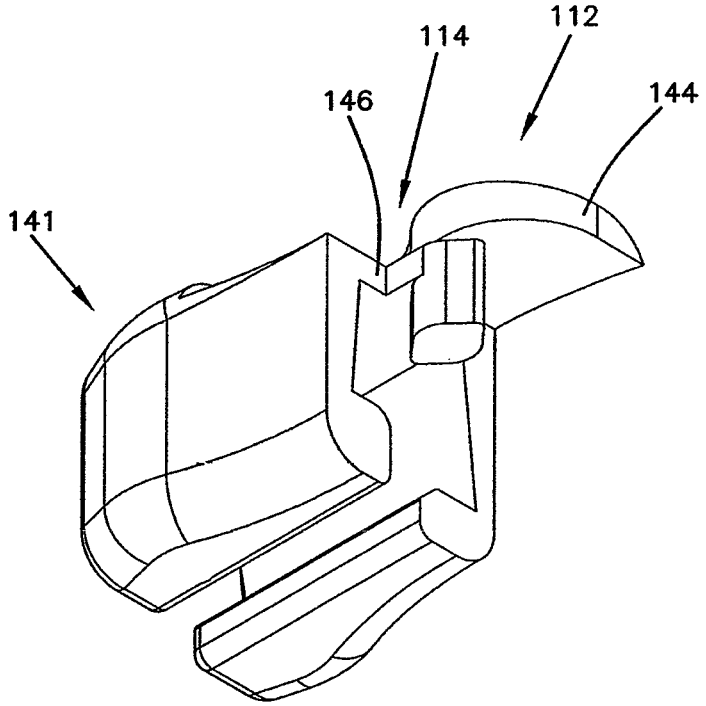
FIG. 5 is a schematic perspective view of one of the sliders of FIG. 4.
Figure 6:
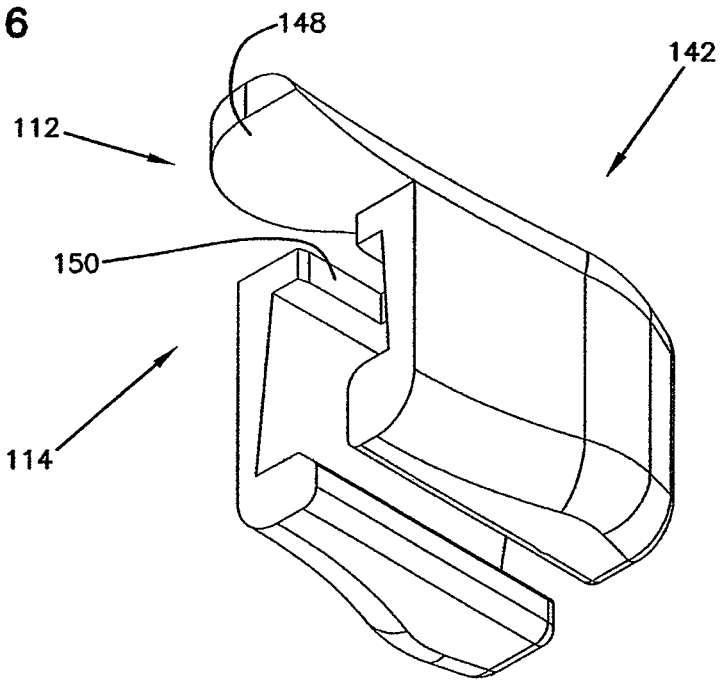
FIG. 6 is a schematic perspective view of one of the sliders of FIG. 4.

In FIGS. 4-6, first slider is shown at 141, while second slider is shown at 142. In this embodiment, each of the first slider 141 and second slider 142 has both projection 112 and receiver 114. In FIG. 5, the first slider 141 can be seen having projection 144, extending as part of its top member 145. The first slider 141 also includes receiver 146 which is adjacent to the projection 144 in the top member 145. In FIG. 6, the second slider 142 has projection 148 as part of its top member 149, and an adjacent receiver 150 defined by the top member 149. The projection 144 of the first slider 141 is received by the receiver 150, while the projection 148 of the second slider 142 is received by the receiver 146 of the first slider 141.

A method of operating a zippered plastic bag can be applied using these principles. A bag, such as bag B of FIG. 1 can be provided. There is a step of opening the mouth 40 by unlocking the zipper closure 11 by moving at least one of the first slider 10 and second slider 10' in a direction away from the other of the first slider 10 and second slider 10'.

There is a step of closing the mouth 40 by interlocking the zipper closure 11 by moving at least one of the first slider 10 and second slider 10' in a direction toward the other of the first slider 10 and second slider 10'.

The step of opening the mouth 40 can include releasing a connection between the first slider 10 and second slider 10'. In some examples, this step of lacing a connection can include removing projection 12 from receiver 14 that is part of a projection-receiver arrangement between the sliders 10, 10'.

B. Example Further Embodiments of Double Sliders, FIGS. 9-55

FIGS. 9-55 illustrate further embodiments of double sliders 100. Parts analogous to those described previously will use common reference numerals. Each of the sliders has a body 17, a top member 54, and first and second sidewalls 20, 21 depending therefrom. Many embodiments will also include separator finger 18 to permit separation of the male and female profiles 14, 15 of the zipper closure 11.

The double sliders 100 of FIGS. 9-55 can be useable with Bag B, which has the zipper closure 11 extending along a mouth of bag B (FIG. 1) and in which the zipper closure 11 has male track 12 and female track 13. As described above in connection with FIG. 3, the male and female profiles 14 and 15 have complementary cross-sectional shapes. They are closed by engaging a bottom of the elements together first and then rolling the elements to a closed position toward the top thereof. The cross-sectional shapes of the interlocking male and female profiles 14 and 15 are set forth in, as mentioned above, U.S. Pat. No. 5,007,143; as well as U.S. Pat. No. 8,087,826 which is incorporated herein by reference.

The double sliders 100 of FIGS. 9-55 can be used to open and close the zipper closure 11. As described previously, tracks 12 and 13 have interlocking male and female profiles 14 and 15 extending the length thereof in the form of rib and groove elements on the respective tracks. The tracks 12 and 13 may further include ears 34, 35 (FIG. 3). Separation of the male and female profiles 14 and 15 by the finger 18 can be accomplished by the finger 18 engaging the tracks 12 and 13. In some embodiments, this result is achieved by the finger 18 engaging between the ears 34, 35 and unrolling the profiles 14, 15.

As mentioned previously, the two sliders of the double slider 100 can include projection receiver arrangement 110. In addition to the arrangement described above in connection with FIGS. 1-8, the projection-receiver arrangement 110 may include at least one of a receiver defined by one of the sidewalls 20, 21, or a deflectable tang. These features are described more fully below.

1. The Embodiment of FIGS. 9-16

In reference first to the embodiment of FIGS. 9-16, double slider 100 depicted includes a first slider 200 and a second slider 202. The first slider 200 and second slider 202 are configured and arranged to be selectively linked together and slide as a single unit along the zipper closure 11. That is, when the first slider 200 and second slider 202 are linked together, the zipper closure 11 remains closed when the linked sliders 200, 202 are moved along the zipper closure 11 in any direction. When the two sliders 200, 202 are released from one another, the zipper closure 11 can be opened by moving 1 or both of the two sliders 200, 202 along the zipper closure 11 in a direction opposite one another.

In the embodiment of FIGS. 9-16, the projection-receiver arrangement 110 includes a receiver 204 (FIG. 9) defined by at least one of the sidewalls 20, 21. A projection 206 (FIG. 9) extends from one of the sidewalls 20, 21 of the other of the first and second sliders 200, 202.

In the particular embodiment illustrated in FIGS. 9-16, each of the first slider 200 and second slider 202 has both projection 206 and receiver 204. While many embodiments are possible, in the embodiment illustrated in FIGS. 9-16, the receiver 204 is defined as a recess 208 (FIGS. 13-16) defined by one of the sidewalls 20, 21. In the first slider 200, the recess 208 is in the sidewall 20, while in the second slider 202, the recess 208 is in the sidewall 21.

The recess 208 is sized to receive projection 206, embodied as a tab 210. In the embodiment shown, the tab 210 is on the sidewall opposite of the sidewall defining the recess 208. Thus, for first slider 200, the tab 210 extends or projects from sidewall 21 toward the second slider 202, when both sliders 200, 202 are operably positioned on the zipper closure 11. The second slider 202 has tab 210 extending from sidewall 20 such that it projects in a direction toward the first slider 200, when both the first slider 200 and second slider 202 are operably assembled on the zipper closure 11.

Figure 11:
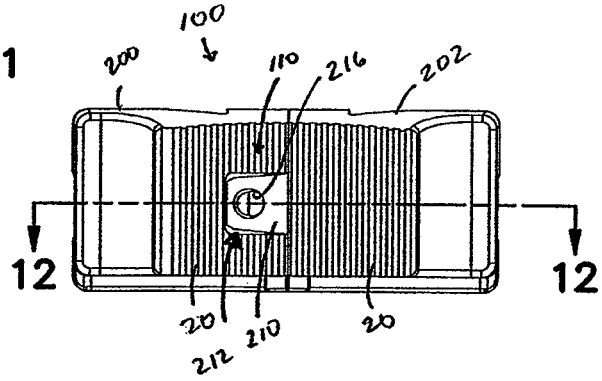
FIG. 11 is a side view of the engaged double slider of FIG. 10.

In the embodiment of FIGS. 9-16, the projection-receiver arrangement 110 includes a locking mechanism 212 (FIG. 11). The locking mechanism 212 permits the first slider 200 and second slider 202 to be selectively linked or locked together and selectively released apart from each other. In this embodiment, the locking mechanism 212 includes a protrusion 214 extending from wall 215 in the recess 208, and an aperture 216 defined by the tab 210.

The protrusion 214 and the aperture 216 are sized such that the protrusion 214 will fit within the aperture 216 sufficient to link the first slider 200 and second slider 202 together.

Figure 12:
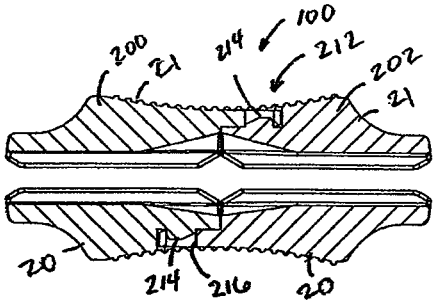
FIG. 12 is a cross-sectional view of the double slider of FIGS. 10 and 11, the cross-section being taken along the line 12-12 of FIG. 11.
Figure 13:
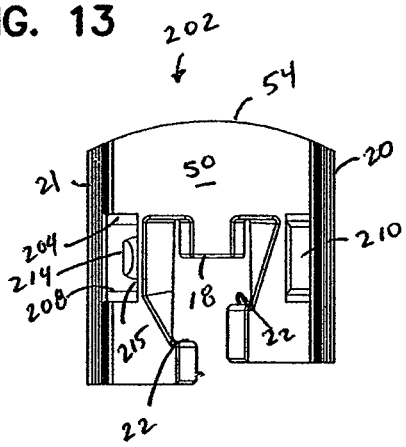
FIG. 13 is an end view of the double slider of FIG. 14.
Figure 15:
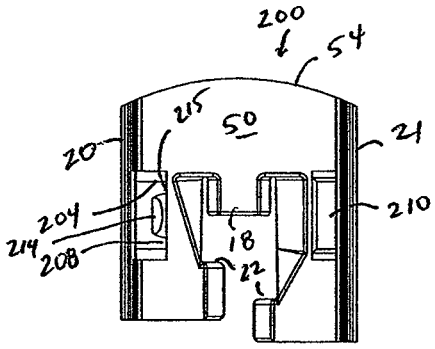
FIG. 15 is an end view of the slider of FIG. 16.
Figure 14:
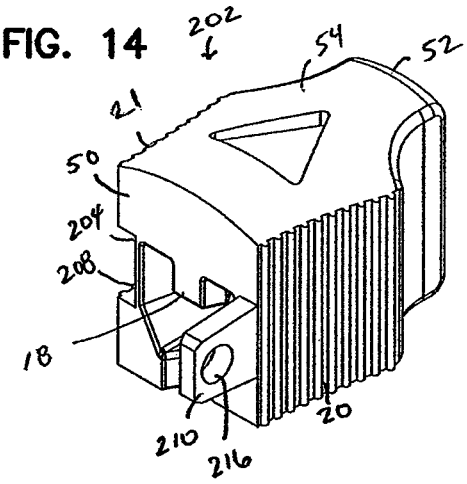
FIG. 14 is a perspective view of one of the sliders of the double slider of FIGS. 9-12.
Figure 16:
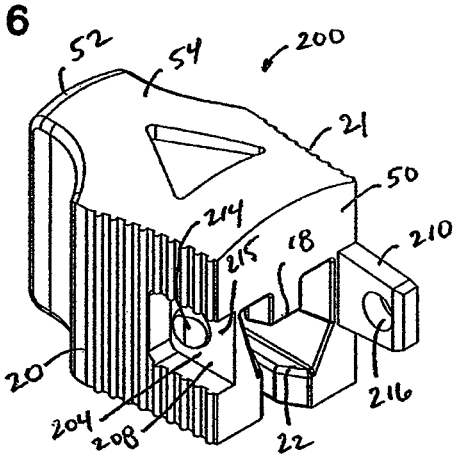
FIG. 16 is a perspective view of a second of the sliders of the double slider of FIGS. 9-12.
Figure 17:
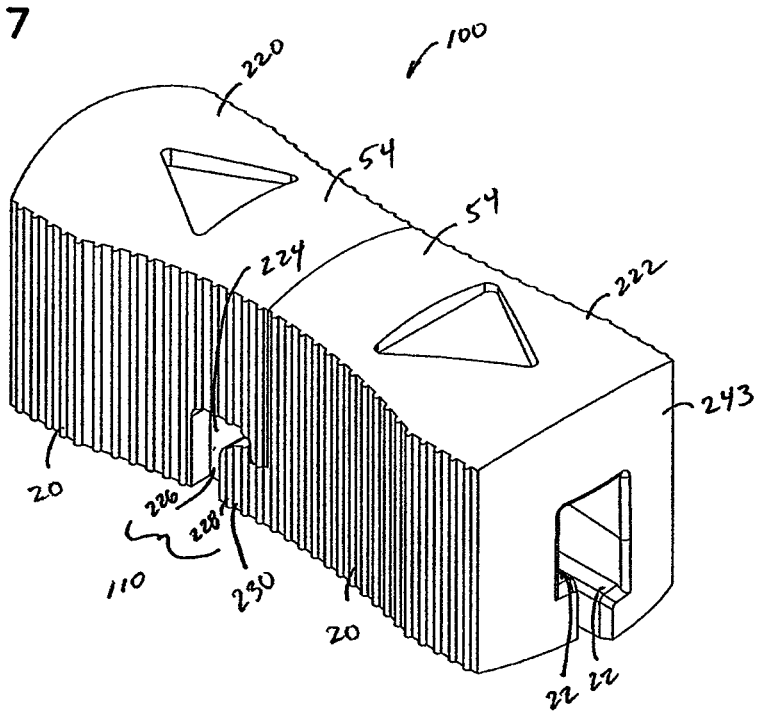
FIG. 17 is a perspective view of another embodiment of a double slider, usable with the fastener of FIGS. 1-3, the double slider being in an engaged position.
Figure 18:
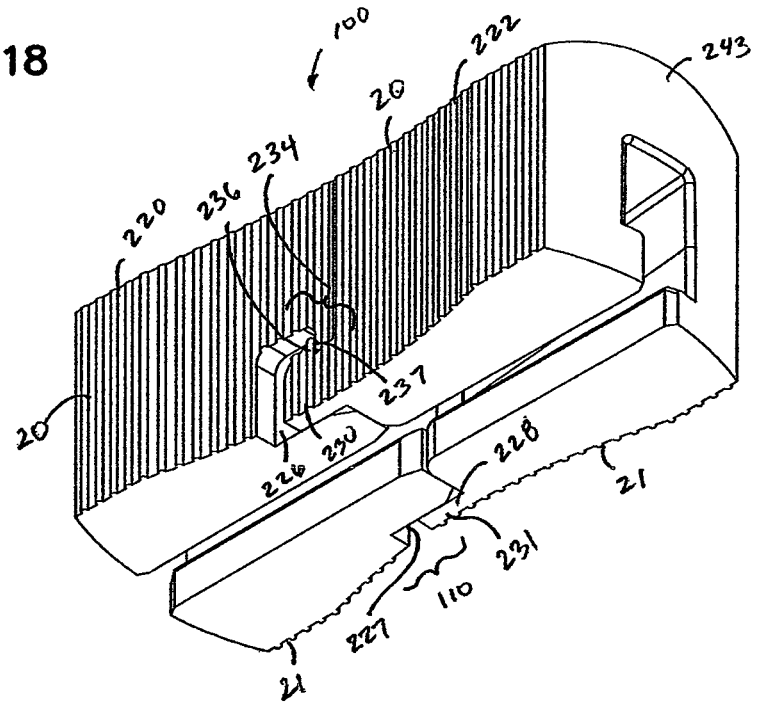
FIG. 18 is another perspective view of the double slider of FIG. 17.

FIG. 12 shows a cross-section depicting the first slider 200 and second slider 202 linked together through the locking mechanism 212. As can be seen in FIG. 12, the tab 210 from the first slider 200 is within the recess 208 of the second slider 202, with the protrusion 214 from the second slider 202 protruding into the aperture 216 of the tab 210. The tab 210 of the second slider 202 is extending into the recess 208 of the first slider 200, while the protrusion 214 of the first slider 200 is extending or protruding into the aperture 216 defined by the tab 210.

When a person decides to release the first slider 200 and second slider 202 apart, the first slider 200 and second slider 202 can be pulled apart or twisted or moved laterally relative to each other to deflect the respective tabs 210 and pull the respective protrusions 214 from the respective apertures 216.

In alternate embodiments, one of the first and second sliders 200, 202 could have both tabs on each sidewall 20, 21, while the other of the sliders 200, 202 could have a respective recess 208 on each sidewall 20, 21.

2. The Embodiment of FIGS. 17-22

FIGS. 17-22 illustrate another embodiment of double slider 100. In the embodiment of FIGS. 17-21, the double slider 100 includes first slider 220 and second slider 222. The first slider 220 and second slider 222 can be selectively linked together and slide as a single unit along the zipper closure 11.

Figure 21:
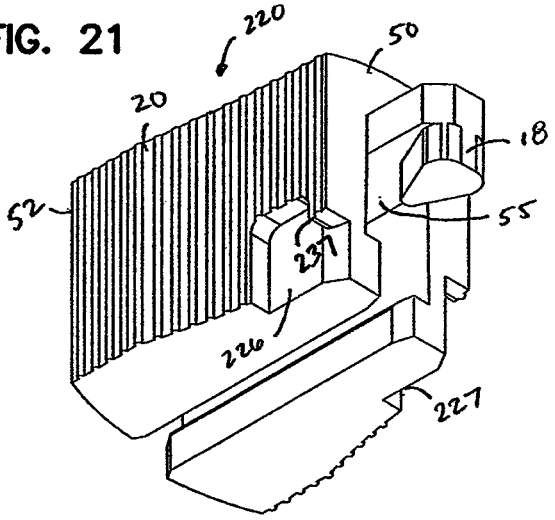
FIG. 21 is a perspective view of another of the sliders used in the double slider of FIGS. 17 and 18.

In this embodiment, only the first slider 220 has separator finger 18. As can be seen in FIG. 21, the separator finger 18 projects axially from the opening end 50 of the first slider 220 in a direction to engage and be received by the second slider 222. The separator finger 18 in the first slider 220 depends from the internal surface 55 of the top member 54 and is between the first and second sidewalls 20, 21.

The second slider 222 in this embodiment has its first and second sidewalls 20, 21 with internal surfaces spaced sufficiently close together to press, or engage, the male and female profiles 14, 15 into interlocking relationship as the second slider 222 is moved along the tracks 12, 13. The second slider 222 is separator-finger free and operates only to press, or engage, the male and female profiles 14, 15 into interlocking relationship as the second slider 222 is moved along the tracks 12, 13 of the closure 11.

In this embodiment, the second slider 222 does not have an opening end and closing end, but rather, has a first end 242 and opposite second end 243. The first end 242 will engage against the opening end 50 of the first slider 220.

Figure 19:
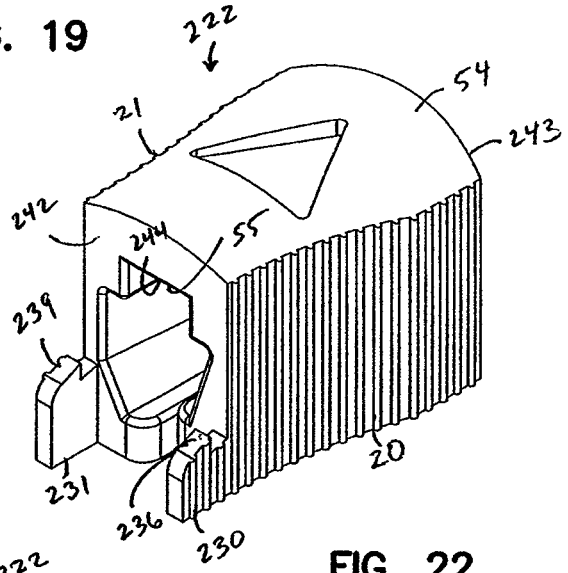
FIG. 19 is a perspective view of one of the sliders used in the double slider of FIGS. 17 and 18.
Figure 20:
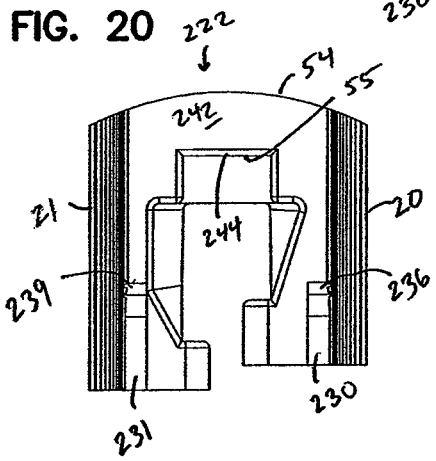
FIG. 20 is an end view of the slider of FIG. 19.
Figure 22:
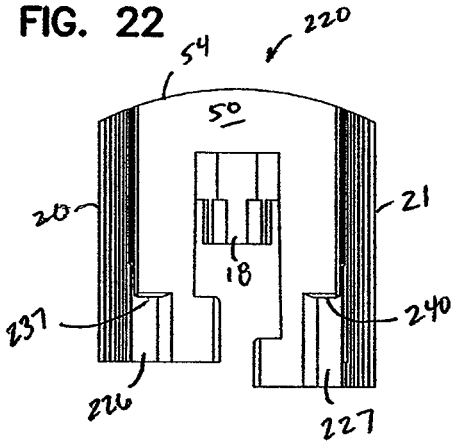
FIG. 22 is an end view of the slider of FIG. 21.

As can be seen in FIGS. 19 and 20, the second slider 222 includes a finger-receiving cavity 244 defined by the internal surface 55 of the top member 54 for receiving the projecting finger 18 of the first slider 220.

When the first slider 220 and second slider 222 are linked together, the two sliders 220, 222 will slide as a single unit along the zipper closure 11. When the first slider 220 and second slider 222 are selectively released from one another, they can slide individually and independently along the zipper closure 11, but only the first slider 220 will operate to open the zipper closure 11. Sliding the second slider 222 independently of the first slider 220 will not open the zipper closure 11.

To unlock the zipper closure 11 using the double slider 100 of FIGS. 17-21, after the first slider 220 and 222 are released from each other, the first slider 220 is moved in a direction away from the second slider 222. To open most of the zipper closure 11, the second slider 222 needs to be against one of the clips 23 (FIG. 1), while the first slider 220 is moved in a direction away from the second slider 222.

The first slider 220 and second slider 222 include projection-receiving arrangement 110 for selective linking together of the sliders 220, 222.

The projection-receiver arrangement in the embodiment of FIGS. 17-21 includes at least one receiver 224 (FIG. 17) in one of the sidewalls 20, 21. In the embodiment shown, the first slider 220 has receiver 224 in the form of a recess 226, 227 in each sidewall 20, 21, respectively.

The second slider 222 includes projection 228 (FIG. 17) to be received by the receiver 224. In the embodiment shown, the projection 228 includes a tab 230 extending from sidewall 20, and tab 231 extending from sidewall 21. The tab 230 is sized to be received by the recess 226, and the tab 231 is sized to be received by the recess 227.

The projection-receiver arrangement 110 can include a locking mechanism 234 (FIG. 18) to provide selective linking and unlinking of the first slider 220 and second slider 222 together. The locking mechanism 234, in this embodiment, includes a hook 236 on the tab 230 and a catch 237 defined by the recess 226. The hook 236 will engage behind the catch 237 to help lock the sliders 220, 222 together.

Similarly, the tab 231 includes hook 239 (FIG. 19). A catch 240 (FIG. 22) is defined by the recess 227 for engaging the hook 239.

Many embodiments are possible, and while this embodiment shows both tabs 230, 231 extending from second slider 222 and both recesses 226, 227 defined by first slider 220, it should be understood that first slider 220 and second slider 222 could have one of each recess and tab.

To releasably link or secure together the first slider 220 to the second slider 222, the tabs 230, 231 are inserted into the recesses 226, 227. The tabs 230, 231 will deflect allowing the hooks 236, 239 to engage behind the catches 237, 240. To release the connection between the first slider 220 and second slider 222, the sliders 220, 222 are either pulled apart from one another or slightly angled or twisted relative to each other to disengage the hooks 236, 239 from the catches 237, 240.

3. The Embodiment of FIGS. 23-29

Figure 27:
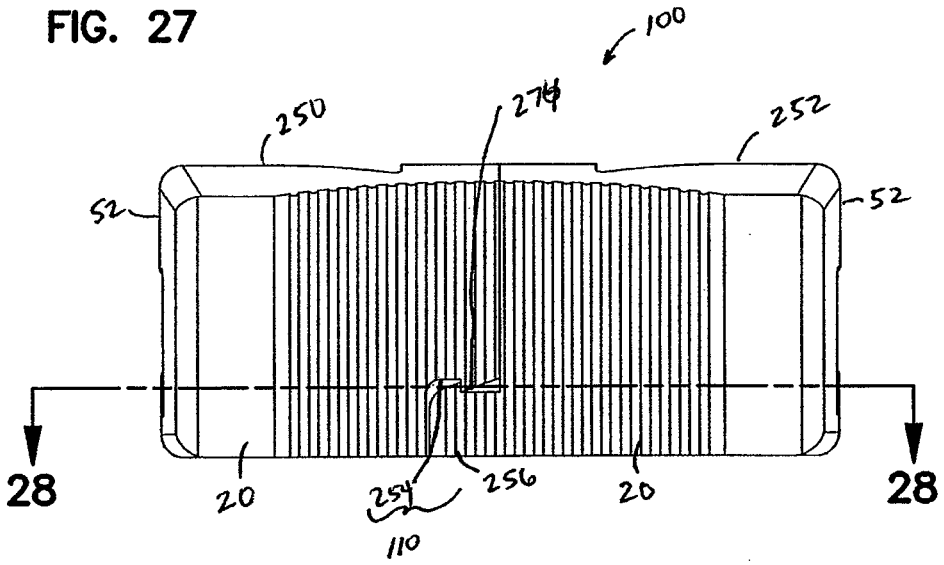
FIG. 27 is a side view of an example embodiment the double slider utilizing the sliders of FIGS. 23-26, usable with the fastener of FIGS. 1-3, the double slider being in an engaged position.
Figure 28:
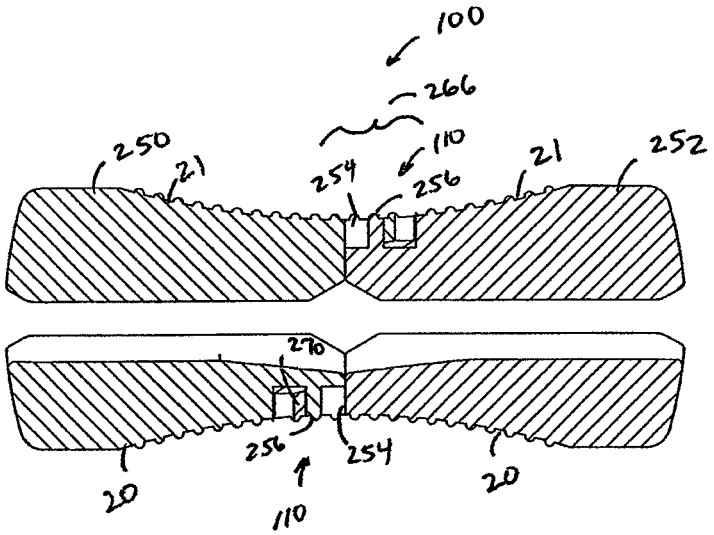
FIG. 28 is a cross-sectional view of the double slider of FIG. 27, the cross-section being taken along the line 28-28 of FIG. 27.
Figure 29:
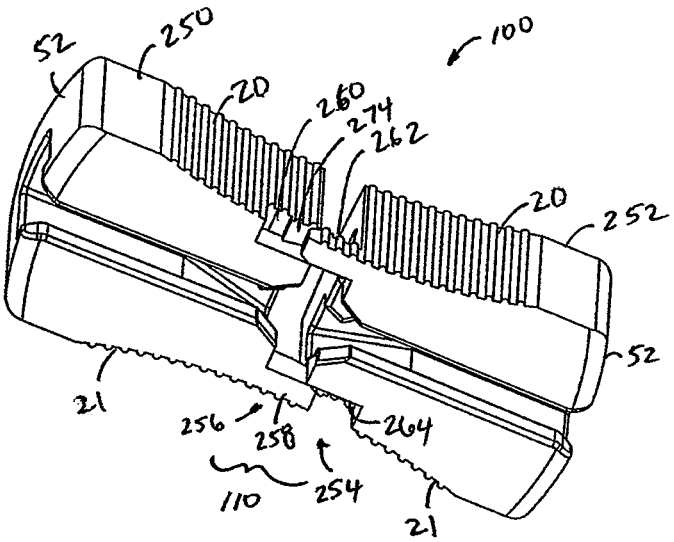
FIG. 29 is a perspective view of the double slider of FIGS. 27 and 28 in a disengaged position.

Another embodiment of double slider 100 is shown in FIGS. 27-29, with the first and second sliders of FIGS. 27-29 being depicted in FIGS. 23-26.

First, in reference to FIGS. 27-29, the double slider 100 includes first slider 250 and second slider 252. As with the previous embodiments, the first slider 250 and second slider 252 can be selectively linked together and slide as a single unit along the zipper closure 11. When the sliders 250, 252 are selectively released from one another, they can slide individually along the zipper closure 11.

The zipper closure 11 can be opened by moving one or both of the sliders 250, 252 along the zipper closure 11 in a direction opposite of the other. In this embodiment, both sliders 250, 252 can operate to open the zipper closure when moved in a direction away from the other slider 250, 252. When the sliders 250, 252 are linked together, and the linked sliders move together along the zipper closure 11, the zipper closure 11 remains closed.

The first slider 250 and second slider 252 include projection-receiver arrangement 110 to allow selective releasable connection between the first slider 250 and second slider 252. In this embodiment, the projection-receiver arrangement 110 includes at least a receiver 254 defined by one of the sidewalls 20, 21.

Many embodiments are possible. In the embodiment depicted in FIGS. 23-28, each of the first slider 250 and second slider 252 includes both a projection 256 and receiver 254. In other embodiments, the sliders 250, 252 can have only one or more projections or only one or more receivers.

Figure 23:
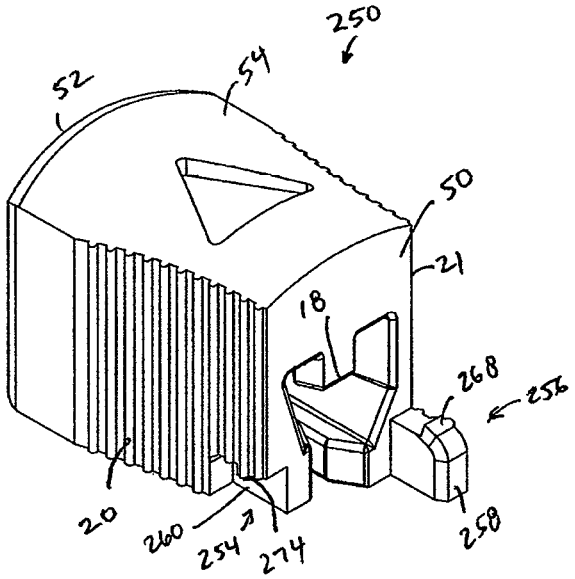
FIG. 23 is a perspective view of another embodiment of a sliders used in a double slider of FIGS. 27 and 28.
Figure 24:
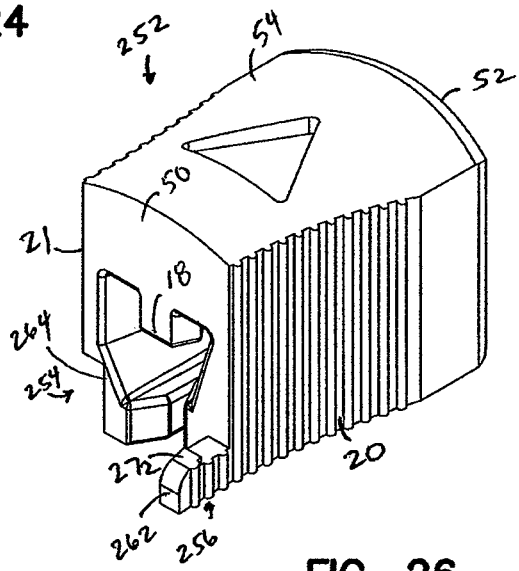
FIG. 24 is a perspective view of another embodiment of a sliders, engageable with the slider of FIG. 23, and used in the double slider of FIGS. 27 and 28.

In FIG. 23, the first slider 250 has a projecting tab 258 extending or projecting from the end 50 and from the sidewall 21. The opposite sidewall 20 of the first slider 250 defines a recess 260.

The second slider 252 has projecting tab 262 extending from sidewall 20, while the opposite sidewall 21 defines recess 264.

The tabs 258, 262 and recesses 260, 264 are sized and configured to receive and engage each other. See FIGS. 27 and 28.

Figure 25:
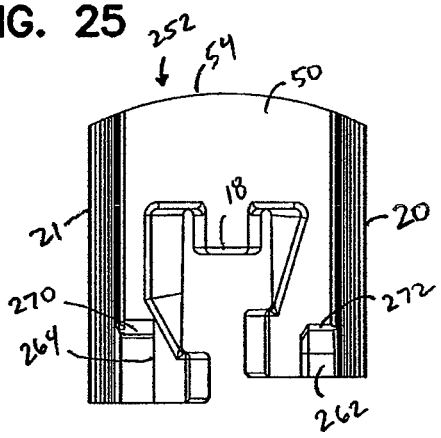
FIG. 25 is an end view of the slider of FIG. 24.
Figure 26:
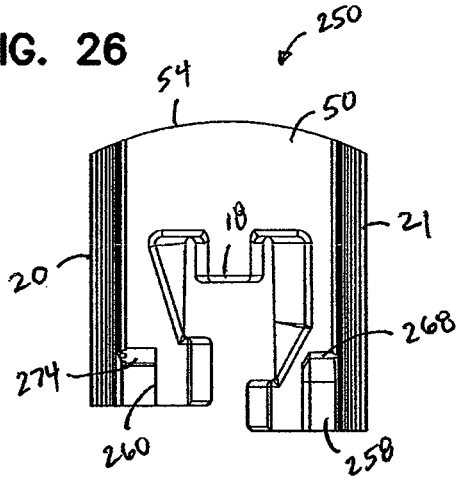
FIG. 26 is an end view of the slider of FIG. 23.

The projection-receiver arrangement 110 of FIGS. 23-28 includes a locking mechanism 266 (FIG. 28) for selectively locking together the projection-receiving arrangement 110. In this embodiment, the locking mechanism 266 includes a hook 268 (FIG. 23) on tab 258, which engages behind a catch 270 (FIG. 25). Similarly, the tab 262 has a hook 272 (FIG. 24) which engages behind a catch 274 (FIGS. 23, 26, and 27) defined as part of the recess 260.

To releasably connect the first slider 250 and second slider 252, the opening ends 50 of the first slider 250 and 252 are pushed together such that the tab 258 is received by the recess 264, and the hook 268 engages and snaps behind the catch 270. At the same time, the tab 262 will be received by the recess 260, and the hook 272 will snap behind the catch 274. To release the connection between the first slider 250 and second slider 252, the two sliders can be pulled apart, or they can also include a twisting or torsion force relative to each other to release the locking mechanism 266.

4. The Embodiment of FIGS. 30-37

FIGS. 30-37 illustrate another embodiment of double slider 100. The double slider 100 in FIGS. 30-37 includes a first slider 280 and a second slider 282. As with the previous embodiments, the first slider 280 and second slider 282 can be operably mounted on the zipper closure 11 and selectively linked together to slide along as a single unit along the zipper closure 11.

When the two sliders 280, 282 are linked together, the zipper closure 11 remains closed. When the two sliders 280, 282 are selectively released from one another and slide individually along the zipper closure 11, at least one of the sliders 280, 282 will operate to open the zipper closure 11. In this particular embodiment, both the first slider 280 and the second slider 282 can open the zipper closure 11, when the sliders 280, 282 are moved apart from each other.

The first slider 280 and second slider 282 include projection-receiver arrangement 110 to allow selective releasable connection there between.

In this embodiment, the projection-receiver arrangement 110 includes a projection 283 in the form of a deflectable tang 284. The deflectable tang 284, in this embodiment, is part of the first slider 280. The tang 284 has at least one locking shoulder 286 (FIG. 33).

The second slider 282 defines a receiver 287 (FIG. 32) in the form of a cavity 288 (FIGS. 32, 36, and 37) with a catch 290 (FIGS. 32 and 36) to receive the deflectable tang 284 and engage the locking shoulder 286 and catch 290.

Figure 33:
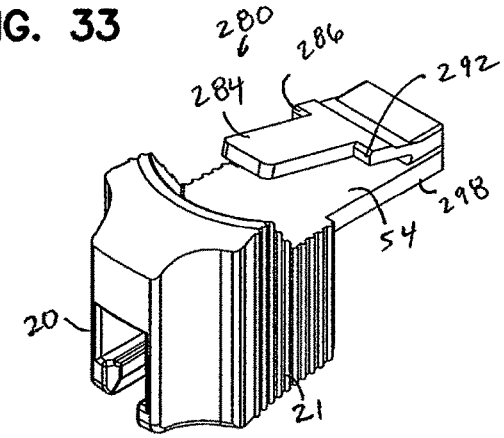
FIG. 33 is a perspective view of one of the sliders used in the double slider of FIGS. 30-032.
Figure 34:
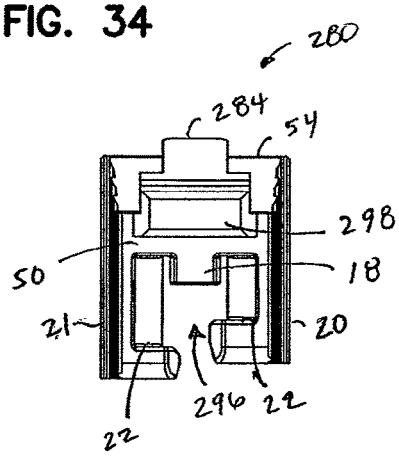
FIG. 34 is an end view of the slider of FIG. 33.
Figure 35:
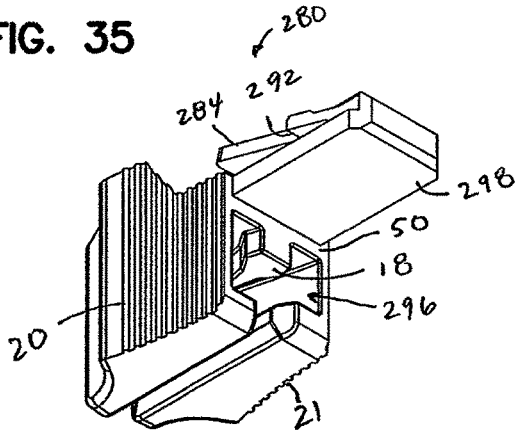
FIG. 35 is another perspective view of the slider of FIG. 33.
Figure 36:
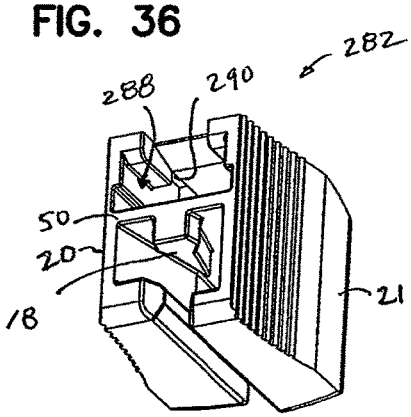
FIG. 36 is a perspective view of the other of the sliders of FIGS. 30-32, which engages the slider of FIGS. 33-35.
Figure 37:
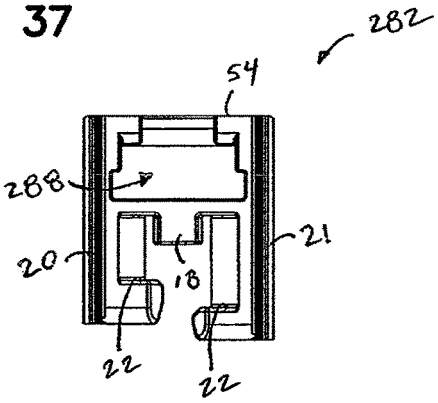
FIG. 37 is an end view of the slider of FIG. 36.

In the embodiment illustrated, the tang 284 includes a second shoulder 292 (FIGS. 33 and 35). The cavity 288 defines a second catch 294. The tang 284 will be received within the cavity 288, and the locking shoulders 286, 292 will engage against the catches 290, 294 when the tang is in its position deflected upward and away from a remaining portion of the top member 54 of the first slider 280.

To release the connection between the first slider 280 and second slider 282, the tang 284 can be deflected downwardly in a direction toward the rest of the first slider 280, which will cause the locking shoulders 286, 292 to be released from engagement against the catches 290, 294, and then the first slider 280 and second slider 282 can be pulled axially apart.

Figure 30:
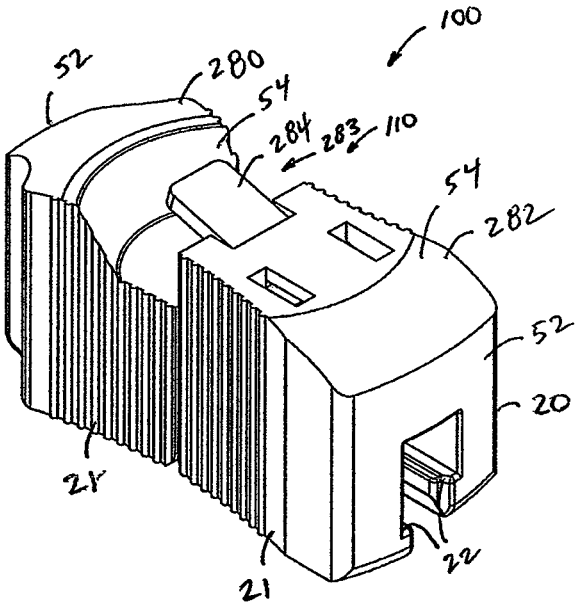
FIG. 30 is a perspective view of another example of a double slider, usable with the fastener of FIGS. 1-3, the double slider being an engaged position.
Figure 31:
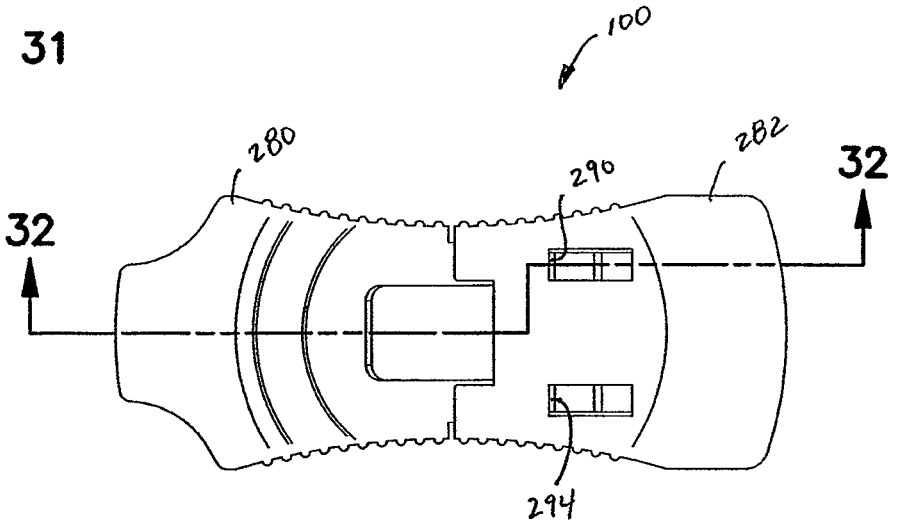
FIG. 31 is a top view of the double slider of FIG. 30.
Figure 32:
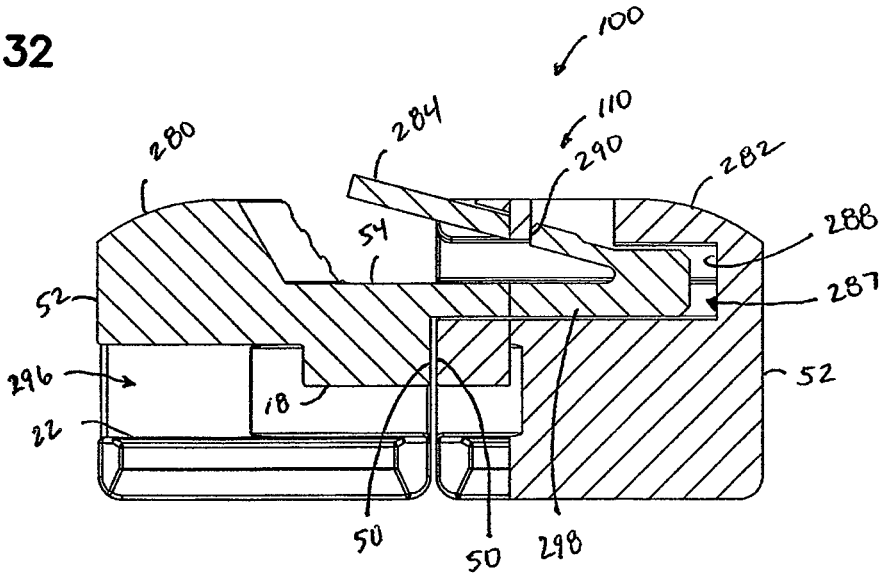
FIG. 32 is a cross-sectional view of the double slider of FIGS. 30 and 31, the cross-section being taken along the line 32-32 of FIG. 31.

As can be seen in FIGS. 30, 32, and 35, the deflectable tang 284 projects from the top member 54 of the first slider 280. Underneath the tang, the top member 54 has an extension 298 extending or projecting beyond the opening 296 (FIG. 34) that receives the zipper closure 11. This extension 298 of the top member 54 is received within the cavity 288 of the second slider 282, so that the respective opening ends 50 of the first slider 280 and second slider 282 may be pushed immediately adjacent to and facing each other, when the two sliders 280, 282 are selectively linked to each other.

To open the zipper closure 11, at least one of the first slider 280 and second slider 282 is moved in a direction away from the other. This can be done by releasing projection in the form of tang 284 on the first slider 280 from receiver in the form of cavity 288 defined by the second slider 282.

5. The Embodiment of FIGS. 38-42 and 52-55

Another embodiment of double slider 100 is illustrated in FIGS. 38-42 and 52-55. The double slider 100 in this embodiment includes a first slider 310 and a second slider 312. The first slider 310 and second slider 312 can be selectively linked together and slide as a single unit along the zipper closure 11. They can be selectively released from one another and slide individually along the zipper closure 11. When the two sliders 310, 312 are linked together, the zipper closure 11 remains closed. When the two sliders 310, 312 are released from one another, the zipper closure 11 can be opened by moving at least one of the two sliders 310, 312 away from the other slider. In this embodiment, both the first slider 310 and second slider 312 can operate to open the zipper closure 11 when moved in a direction away from the other of the sliders 310, 312.

The sliders 310, 312 are selectively releasably connected to each other by projection-receiver arrangement 110. In this embodiment, a projection 314 (FIG. 38) is embodied as at least one tang 316. A receiver 318 (FIG. 38) is embodied as a cavity 320 defined by the second slider 312.

In this embodiment, the projection 314 includes first and second deflectable tangs 316, 317 on the first slider 310. The cavity 320 receives both deflectable tangs 316, 317. The tangs 316, 317 deflect laterally inwardly toward the main body of the first slider 310 and toward a central longitudinal axis 338 (FIG. 42) when entering the cavity 320, and then deflect laterally outwardly away from the main body and away from the longitudinal axis 338 to lock into the second slider 312.

Figure 38:
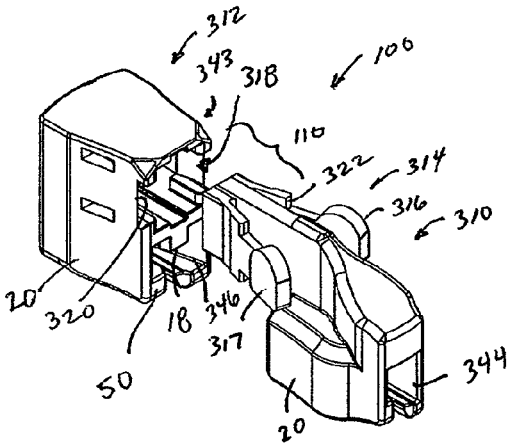
FIG. 38 is a perspective view of another example embodiment of a double slider usable with the fastener of FIGS. 1-3, the double slider being in a disengaged position.
Figure 39:
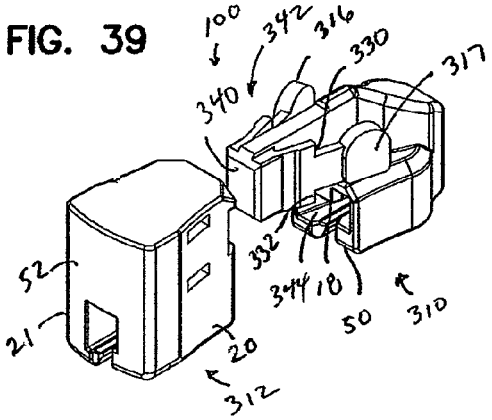
FIG. 39 is another perspective view of the double slider of FIG. 38 being in a disengaged position.
Figure 40:
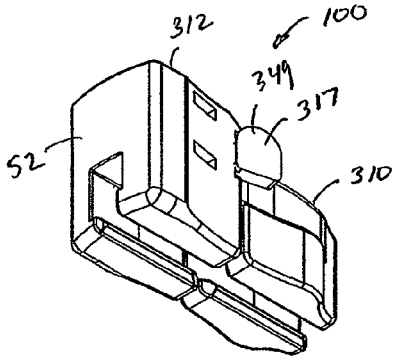
FIG. 40 is a perspective view of the double slider of FIGS. 38 and 39 but in an engaged position.
Figure 41:
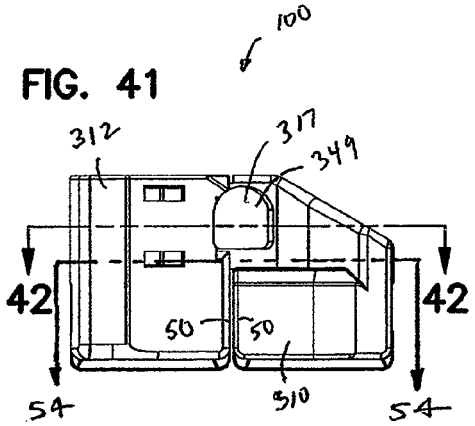
FIG. 41 is a side view of the engaged double slider of FIG. 40.
Figure 42:
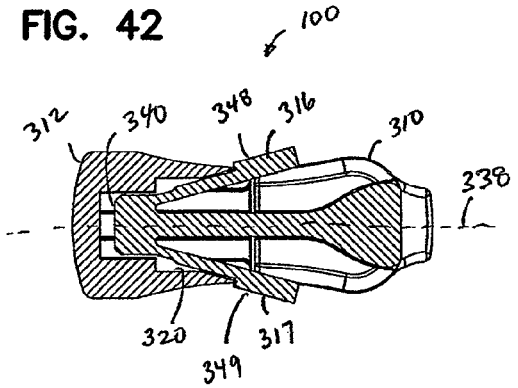
FIG. 42 is a cross-sectional view of the double slider of FIGS. 40 and 41, the cross-section being taken along the line 42-42 of FIG. 41.
Figure 43:
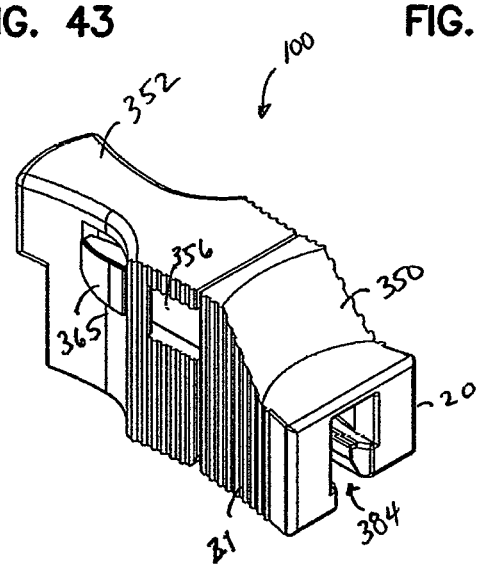
FIG. 43 is a perspective view of another example of a double slider, usable with the faster of FIGS. 1-3, the double slider being in an engaged position.
Figure 44:
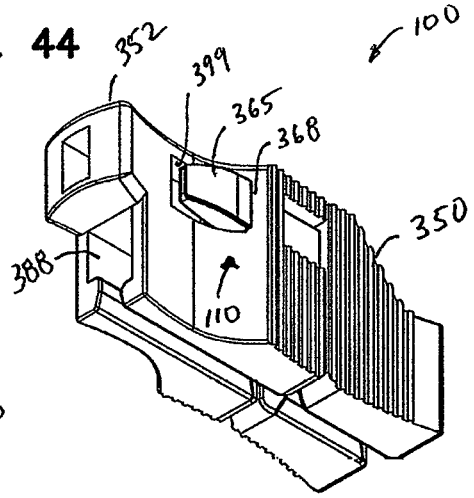
FIG. 44 is another perspective view of the double slider of FIG. 43.
Figure 45:
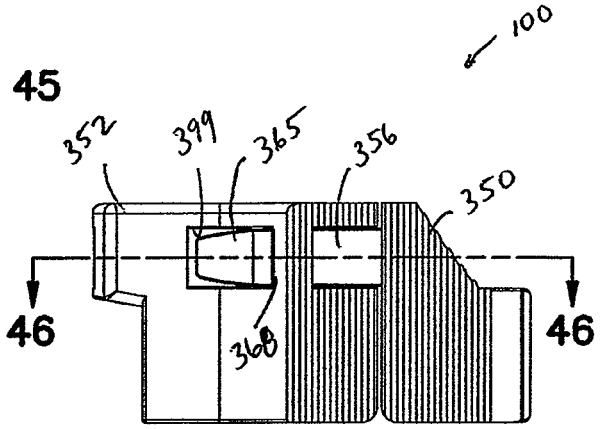
FIG. 45 is a side view of the double slider of FIGS. 43 and 44.
Figure 55:
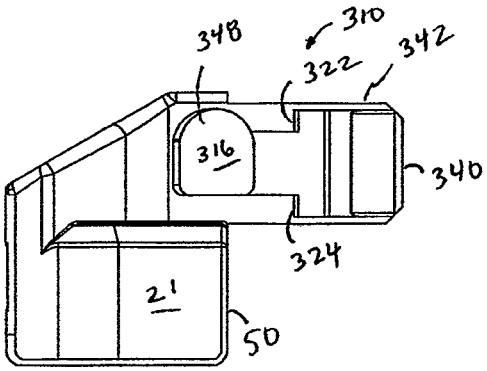
FIG. 55 is side view of one of the sliders of the double slider of FIGS. 38-42 and 52-54.

The tang 316 includes at least one shoulder 322 (FIGS. 38 and 55). The shoulder 322 on the tang 316 engages a catch 324 (FIG. 53) in the second slider 312. In the example embodiment illustrated in FIG. 55, the tang 316 includes a pair of shoulders 322, 324. The shoulders 322, 324 engage catches 326, 328 (FIG. 53) defined by the second slider 312 within the cavity 320.

Figure 54:
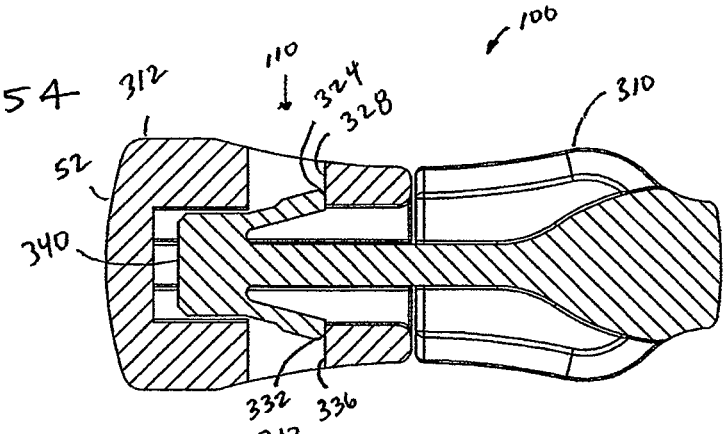
FIG. 54 is a cross-sectional view of the engaged double slider of FIGS. 40-42, the cross-section being taken along the line 54-54 of FIG. 41.
Figure 52:
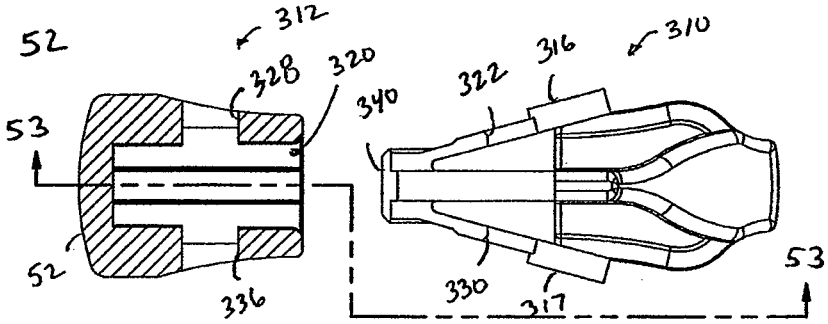
FIG. 52 is a top view with one of the sliders in cross-section of the double slider of FIGS. 38-42.
Figure 53:
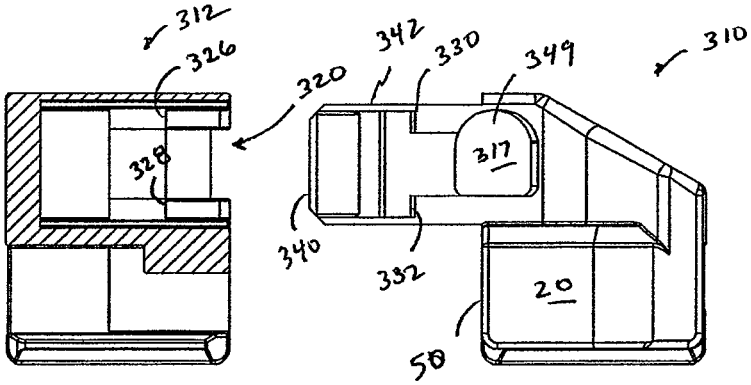
FIG. 53 is a side view of the double slider of FIG. 52.

Similarly, the tang 317 includes at least one shoulder 330, and in the embodiment illustrated, has a pair of shoulders 330, 332 (FIG. 53). The shoulders 330, 332 engage catches defined by the second slider 312 within the cavity 320. The catches engaging the shoulders 330, 332 are analogous and have the same appearance as the catches 326, 328. In FIGS. 52 and 54, one of the catches 336 is visible.

The deflectable tangs 316, 317 are deflectable toward and away from each other and from longitudinal axis 338 (FIG. 42) extending longitudinally through the first slider 310. The tangs 316, 317 include finger holds 348, 349 at free ends of the tangs 316, 317, which are sized and configured to be grasped by a user's fingers to squeeze the tangs 316, 317 together. When the first slider 310 and second slider 312 are operably connected or engage to each other, the finger holds 348, 349 are outside of the cavity 320, while the remaining portion of the tangs 316, 317 is inside of the cavity 320. See FIGS. 40-42.

The first slider 310 includes a connection portion 342, which is projecting or extending from a remaining portion of the first slider 310. In the illustrated embodiment in FIGS. 53 and 55, the connection portion 342 is projecting and extending beyond the opening end 50 of the first slider 310. The opening 344 (FIG. 38) that receives the zipper closure 11 is located below the connection portion 342, when the first slider 310 is operably oriented on zipper closure 11 with the zipper extending along the top of a bag. The connection portion 342 includes distal end 340, which will be the portion of the first slider 310 that first enters the cavity 320 of the second slider 312.

The second slider 312 has its receiving cavity 320 defined by a connection portion 343 (FIG. 38) of the second slider 312 that is above the opening 346 for zipper closure 11, when the slider 312 is operably oriented on the zipper closure 11 when the zipper closure 11 extends along a top of a bag.

To selectively connect the first slider 310 and second slider 312, a person will inserting end 340 of the connecting portion 342 of the first slider 310 into the cavity 320 of the second slider 312. As the first slider 310 is moved axially into the cavity 320 of the second slider 312, the shoulders 322, 324, 330, 332 snap over and engage the catches 326, 328, 336 within the cavity 320 of the second slider 312. This engagement will releasably lock the first slider 310 and second slider 312 together. It will allow the opening ends 50 of the sliders 310, 312 to be immediately adjacent and facing each other.

To release the connection between the first slider 310 and the second slider 312, the finger holds 348, 349 are squeezed toward each other, and the tangs 316, 317 are deflected in a direction toward each other and toward the longitudinal axis 338 of the first slider 310. This allows the shoulders 322, 324, 330, 332 to disengage from the catches 326, 328, 336 in the second slider 332. After disengagement, the first slider 310 and second slider 312 can be separated and moved apart from each other, while the connection portion 342 of the first slider 310 is removed from the cavity 320 of the second slider 312.

6. The Embodiment of FIGS. 43-51

Another embodiment of a double slider 100 is shown in FIGS. 43-51. The double slider 100 includes first slider 350 and second slider 352. The first slider 350 and second slider 352 can be operably mounted on the zipper closure 11. The two sliders 350, 352 are configured and arranged to be selectively linked together and slide as a single unit along the zipper closure 11.

When the two sliders 350, 352 are linked together, the zipper closure 11 remains closed while the linked sliders 350, 352 are moved along the zipper closure 11 in any direction. When the two sliders 350, 352 are selectively released from one another and slide individually along the zipper closure 11, the zipper closure 11 can be opened by moving at least one of the two sliders 350, 352 in a direction opposite of the other. In this embodiment, both the first slider 350 and second slider 352 can operate to open the zipper closure 11 when moved in a direction away from the other of the sliders 350, 352.

The first slider 350 and second slider 352 are selectively linked together by projection-receiver arrangement 110. In this embodiment, a projection 354 (FIG. 46) is part of the first slider 350 and includes a deflectable tang 356. The projection 354 is received by a receiver 358 (FIG. 46) in the second slider 312. The receiver 358 is in the form of a cavity 360 (FIG. 50) defined by the second slider 352.

In this particular embodiment, the first slider 350 includes a pair of tangs 356, 357 (FIG. 48) projecting or extending from the opening end 50 of the first slider 350. The tangs 356, 357, in this embodiment, are in the form of extending tongues or flanges 362, 363, each having a head 365, 366 at a distal end from a remaining portion of the first slider 350. Each head 365, 366 defines a locking shoulder 368, 369 thereon.

Figure 48:
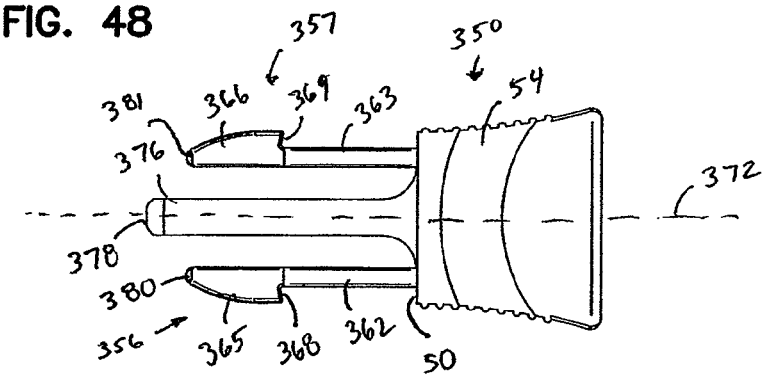
FIG. 48 is a top view of the slider of FIG. 47.

Attention is directed to FIG. 48, which is a top view of the first slider 350. The tangs 356, 357 are deflectable toward and away from a longitudinal axis 372 passing through the first slider 350. The locking shoulders 368, 369 are facing away from the longitudinal axis 372.

The first slider 350, in the illustrated embodiment, further includes a guide bar 376. The guide bar 376 extends from the opening end 50 of the first slider 350. In this embodiment, the guide bar 376 is centered between the flanges 362, 363 of the tangs 356, 357. The guide bar 376 has a distal end 378 which, in this embodiment, extends longer than the free ends 380, 381 of the tangs 356, 357.

The guide bar 376 helps to orient and guide the first slider 310 and second slider 312 together into mating engagement. In this particular arrangement, the distal end 378 of the guide bar 376 will be the first structure to enter the cavity 360 of the second slider 352. Many embodiments and variations are possible.

Figure 47:
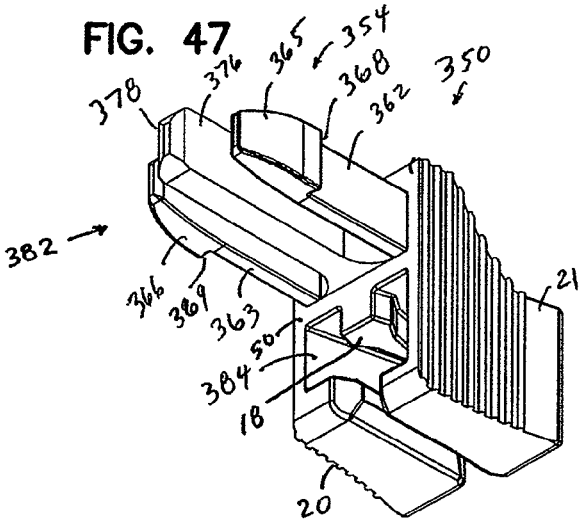
FIG. 47 is a perspective view of one of the sliders of the double slider of FIGS. 43-46.
Figure 50:
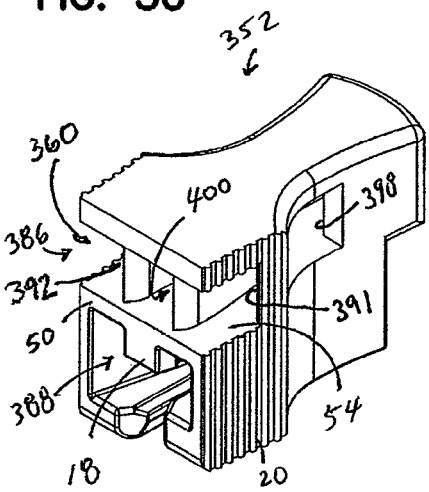
FIG. 50 is a perspective view of another of the sliders of the double slider of FIGS. 43-46, engageable with the slider of FIGS. 47-49.
Figure 49:
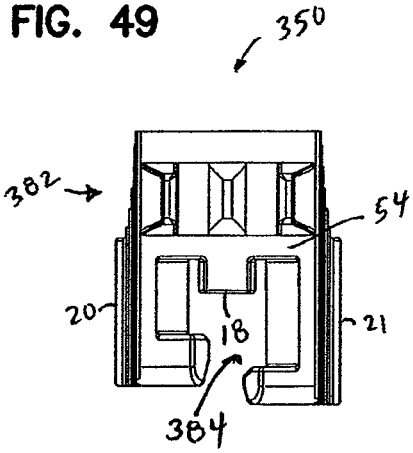
FIG. 49 is an end view of the slider of FIGS. 47 and 48.
Figure 51:
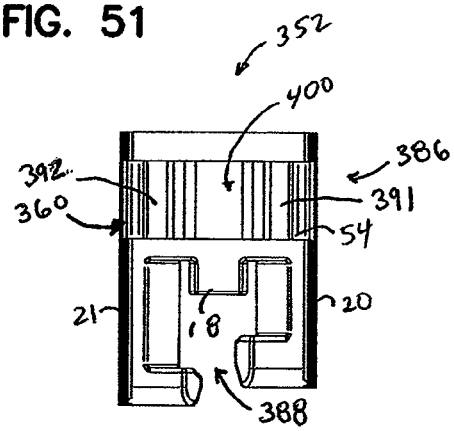
FIG. 51 is an end view of the slider of FIG. 50.

In FIGS. 47 and 49, it can be seen how the first slider 350 has a connection portion 382 which extends above the top member 54 of the first slider 350. That is, the connection portion 382 having the tangs 356, 357 extends above the opening 384 that receives the zipper closure 11, when the first slider 350 is operably mounted on the zipper closure 11 with the zipper across the top of a bag.

The second slider 352 defines cavity 360 in a connection portion 386 (FIGS. 50, 51) which is above the top member 54. The connection portion 386 is above the opening 388 that receives the zipper closure 11, when the second slider 352 is operably mounted on the zipper closure 11 and the zipper closure is along the top of a bag.

The connection portion 386 of the second slider 352 includes, as part of the cavity 360, at least first and second tang-receiving cavities 391, 392. The tang-receiving cavities 391, 392 are sized and arranged to receive the tangs 356, 357.

The connection portion 386 of the second slider 352 defines a pair of catches 394, 395 for engaging the shoulders 368, 369 of the tangs 356, 357. In the embodiment shown, the tang-receiving cavities 391, 392 include apertures 398, 399 extending through the sidewalls 20, 21 of the second slider 352. When the tangs 356, 357 are inserted into the tang-receiving cavities 391, 392 inner walls of the tang-receiving cavities 391, 392 will cause the tangs 356, 357 to deflect inwardly toward the central axis 372 as the inner wall presses against the heads 365, 366. As the two sliders 350, 352 are continued to be moved together axially, the heads 365, 366 will eventually snap into the apertures 398, 399. At this point, the shoulders 368, 369 will engage against the catches 394, 395. This will releasably lock the first slider 350 and second slider 352 together.

Figure 46:
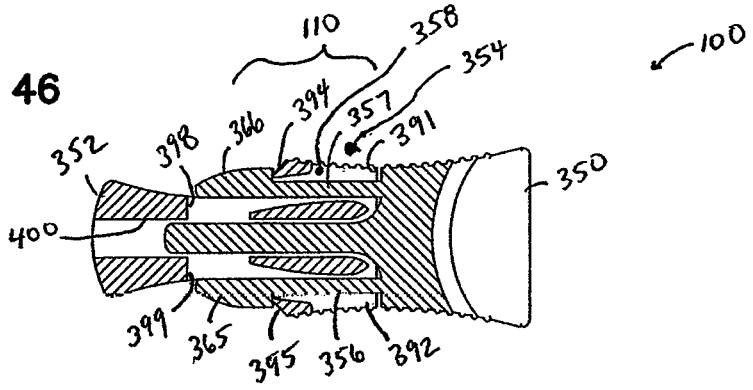
FIG. 46 is a cross-sectional view of the double slider of FIGS. 43-45, the cross-section being taken along the line 46-46 of FIG. 45.

The cavity 360 and the connection portion 386, in the embodiment shown, further include a bar-receiving cavity 400. The bar-receiving cavity 400 is configured and sized to receive the guide bar 376. In FIG. 46, it can be seen how the bar-receiving cavity 400 is located between the tang-receiving cavities 391, 392.

To release the first slider 350 from the second slider 352, the heads 365, 366 on the flanges 362, 363 can be squeezed or pressed in a direction toward each other and toward the longitudinal axis 372. This will allow the shoulders 368, 369 to disengage the catches 394, 395. After disengagement, the first slider 350 and second slider 352 can be pulled axially apart from each other.

The above description represents example principles of this disclosure. Many embodiments can be made applying these principles.

What is claimed is:

1. A double slider for a plastic zipper closure having a male track and a female track including interlocking male and female profiles; the double slider comprising:

(a) a first slider having a body with an opening end and a closing end;

(i) the body including a top member and first and second legs extending therefrom; the first slider having a separator finger depending from an internal surface of the top member and between the first and second legs;

(A) the body adapted to move along top edges of the tracks with the first and second legs straddling the tracks and the finger positioned between the tracks;

(ii) the separator finger being wider toward the opening end of the first slider than at the closing end of the first slider to permit separation of the male and female profiles by the wider end of the finger;

(iii) the first and second legs having internal surfaces spaced sufficiently close together toward the closing end to engage the male and female profiles into interlocking relationship as the first slider is moved along the tracks;

(b) a second slider, releasably connected to the first slider, the second slider having a body with a first end and a second end;

(i) the second slider body including a top member and first and second legs extending therefrom;

(A) the second slider body adapted to move along top edges of the tracks with the first and second legs straddling the tracks;

(ii) the second slider first and second legs having internal surfaces spaced sufficiently close together to engage the male and female profiles into interlocking relationship as the second slider is moved along the tracks;

(c) the first slider and second slider being selectively releasably connected together between an engaged position and a disengaged position;

(i) in the engaged position, the first and second sliders move together along the top edges of the track, and the opening end of the first slider body is against the first end of the second slider body;

(ii) in the disengaged position, the first and second sliders move independent of each other along the top edges of the track and at least the first slider operates to both separate and interlock the male and female profiles independent of the second slider; and (iii) the first slider and second slider having a projection-receiver arrangement to allow the selective releasable connection therebetween, the projection-receiver arrangement including at least one of: a receiver defined by one of the legs, or a deflectable tang.

2. The double slider according to claim 1 wherein:

(a) the second slider has a separator finger depending from an internal surface of the top member and between the first and second legs;

(i) the second slider body adapted to move along top edges of the tracks with the first and second legs straddling the tracks and the finger positioned between the tracks;

(ii) the second slider separator finger being wider toward the first end of the second slider than at the second end of the second slider to permit separation of the male and female profiles by the wider end of the finger, independent of the first slider.

3. The double slider according to claim 1 wherein the second slider is separator-finger free and operates only to engage the male and female profiles into interlocking relationship as the second slider is moved along the tracks.

4. The double slider according to claim 1 wherein the projection-receiver arrangement includes at least one deflectable tang having a locking shoulder on at least one of the first slider and second slider, and a cavity with a catch defined by the other of the first slider and second slider sized to receive the deflectable tang and engage the locking shoulder and catch.

5. The double slider according to claim 4 wherein the at least one deflectable tang includes first and second deflectable tangs on the first slider, the first and second deflectable tangs being deflectable toward and away from each other and from a longitudinal axis through the first slider; the second slider defining the cavity and at least first and second catches to engage the first and second tangs.

6. The double slider according to claim 4 wherein the at least one deflectable tang projects from the top member of the first slider, and the catch is defined by the top member of the second slider.

7. The double slider according to claim 1 wherein the projection-receiver arrangement includes at least one tab projecting from at least one of the legs of the first and second sliders, and the other of the first and second sliders having at least one receiver defined by one of the legs sized to receive the tab.

* * * * *